US011300911B2

(12) United States Patent
Koide et al.

(10) Patent No.: US 11,300,911 B2
(45) Date of Patent: Apr. 12, 2022

(54) IMAGE FORMING DEVICE

(71) Applicant: KONICA MINOLTA, INC., Tokyo (JP)

(72) Inventors: Yasuhiro Koide, Toyohashi (JP); Yoshihito Sasamoto, Hachioji (JP); Makoto Shimazoe, Toyokawa (JP); Yuhei Tatsumoto, Toyokawa (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 17/315,877

(22) Filed: May 10, 2021

(65) Prior Publication Data

US 2021/0356891 A1 Nov. 18, 2021

(30) Foreign Application Priority Data

May 18, 2020 (JP) ..... JP2020-086572

(51) Int. Cl.
*G03G 15/00* (2006.01)

(52) U.S. Cl.
CPC ..... *G03G 15/5029* (2013.01)

(58) Field of Classification Search
CPC ..... G03G 15/0233; G03G 15/5029; G03G 21/06; G03G 2215/00654
See application file for complete search history.

(56) References Cited

U.S. PATENT DOCUMENTS 6,144,817 A * 11/2000 Takeuchi ..... G03G 15/011 347/115
2017/0075248 A1* 3/2017 Tokudome ..... G03G 15/0216

FOREIGN PATENT DOCUMENTS

JP 2007322798 A 12/2007

* cited by examiner

*Primary Examiner* — Hoang X Ngo
(74) *Attorney, Agent, or Firm* — Holtz, Holtz & Volek PC

(57) ABSTRACT

An image forming device includes: a transfer unit transferring a toner image to a sheet; a resistance measurement member disposed on the upstream side in a sheet carriage direction of the transfer unit and for measuring resistance of the sheet; a charge elimination member disposed between the transfer unit and the resistance measurement member in the sheet carriage direction; a first voltage applying unit applying voltage for resistance measurement to the resistance measurement member; and a second voltage applying unit applying voltage of reverse bias of the voltage for resistance measurement to the charge elimination member. The width of a charge elimination region by the charge elimination member is wider than that of a charged region by the resistance measurement member in a direction perpendicular to the sheet carriage direction. The absolute value of the voltage for charge elimination is smaller than that of the voltage for resistance measurement.

9 Claims, 16 Drawing Sheets

IMAGE FORMING DEVICE

CROSS-REFERENCE TO RELATED APPLICATIONS

The entire disclosure of Japanese Patent Application No. 2020-86572, filed on May 18, 2020, is incorporated herein by reference in its entirety.

BACKGROUND

Technological Field

The present invention relates to an image forming device.

Description of the Related Art

An image forming device of an electrophotographic type has a transfer unit transferring a toner image onto a sheet. An image forming device of this kind controls transfer conditions at the time of transferring a toner image onto a sheet on the basis of the electrical resistance of the sheet. In the following description, "electrical resistance" will be simply called "resistance" or "electric resistance".

Patent literature 1 (Japanese Unexamined Patent Application Publication No. 2007-322798) discloses a technique of applying voltage to a roller provided on the upstream side in a sheet carriage direction of a transfer unit and measuring the resistance of a sheet passing through the roller.

RELATED ART LITERATURE

Patent Literature

Patent Literature 1: Japanese Unexamined Patent Application Publication No. 2007-322798

SUMMARY

In the technique described in the Patent Literature 1 (Japanese Unexamined Patent Application Publication No. 2007-322798), however, charges remain in a sheet at the time of measuring the resistance of the sheet by applying voltage to the roller and, due to the residual charges, there is the possibility that a trouble such as poor transfer in the transfer unit occurs.

An object of the present invention is to provide an image forming device in which occurrence of a trouble in a transfer unit accompanying measurement of the resistance of a sheet can be suppressed.

An image forming device according to an aspect of the present invention has: a transfer unit transferring a toner image to a sheet; a resistance measurement member disposed on the upstream side in a sheet carriage direction of the transfer unit and for measuring resistance of the sheet; a charge elimination member disposed between the transfer unit and the resistance measurement member in the sheet carriage direction; a first voltage applying unit applying voltage for resistance measurement to the resistance measurement member; and a second voltage applying unit applying voltage for charge elimination as reverse bias voltage of the voltage for resistance measurement to the charge elimination member. The width of a charge eliminated region by the charge elimination member is wider than that of a charged region by the resistance measurement member in a direction perpendicular to the sheet carriage direction. The absolute value of the voltage for charge elimination is smaller than that of the voltage for resistance measurement.

According to the present invention, occurrence of a trouble in a transfer unit accompanying measurement of resistance of a sheet can be suppressed.

BRIEF DESCRIPTION OF THE DRAWINGS

The advantages and features provided by embodiments of the invention will become more fully understood from the detailed description given hereinbelow and the appended drawings which are given by way of illustration only, and thus are not intended as a definition of limits of the present invention.

DETAILED DESCRIPTION OF EMBODIMENTS

Figure 1:
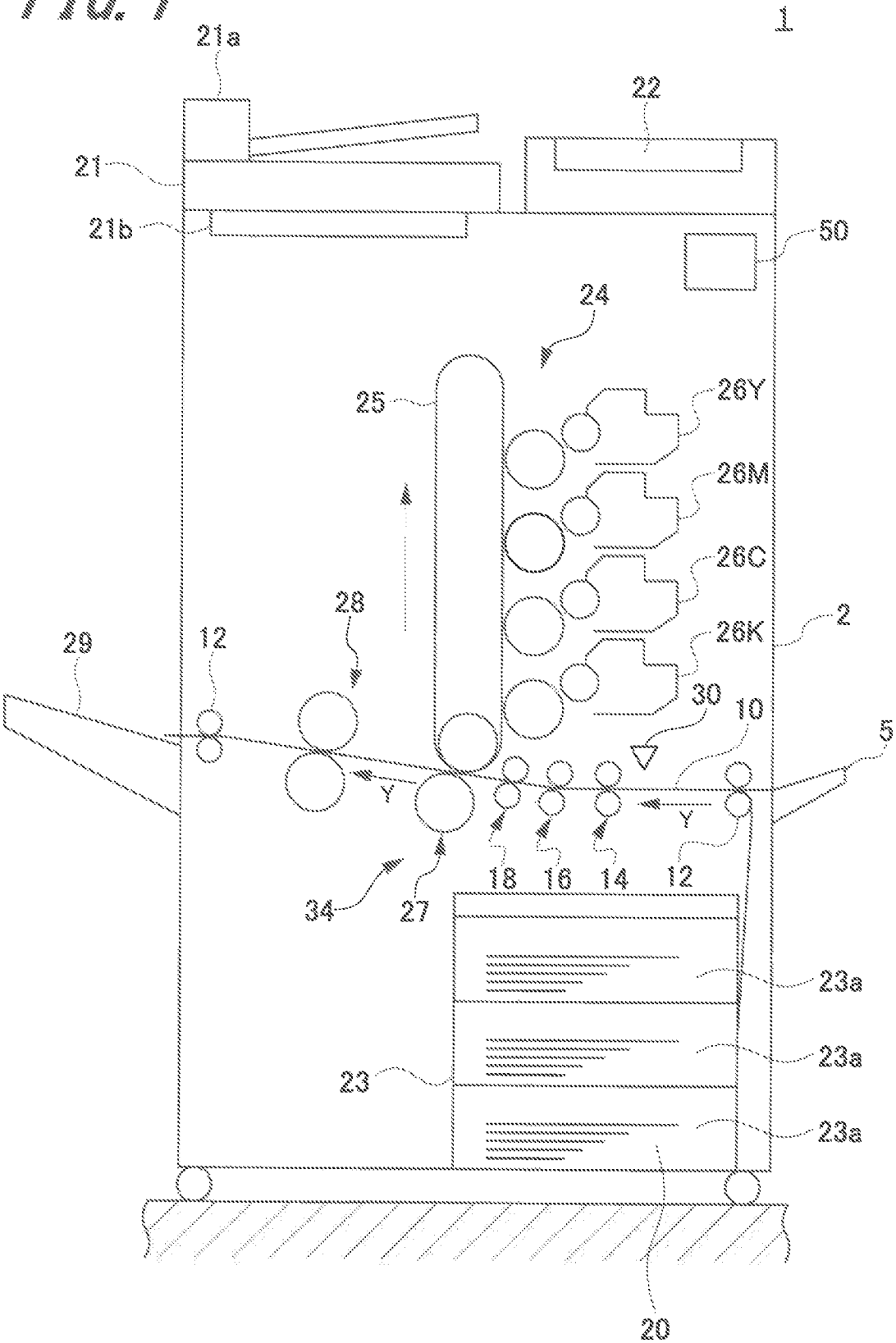
FIG. 1 is a schematic diagram illustrating a general configuration of an image forming device according to an embodiment of the present invention.

Hereinafter, embodiments of the present invention will be specifically described with reference to the drawings. However, the scope of the invention is not limited to the embodiments. In the specification and the drawings, the same reference numerals are designated to components having substantially the same function or configuration and repetitive description of the components will be omitted.

General Configuration of Image Forming Device

FIG. 1 is a schematic diagram illustrating a general configuration of an image forming device according to an embodiment of the present invention.

As illustrated in FIG. 1, an image forming device 1 is an image forming device of an electrophotographic type and is a color image forming device of a tandem type capable of forming a full-color image by superimposing toner images of the colors of yellow (Y), magenta (Y), cyan (C), and black (K).

The image forming device 1 has an image reading unit 21, an operation display unit 22, a sheet supply unit 23, an image forming unit 24, an intermediate transfer belt 25, a transfer unit 27, a fixing unit 28, a sheet ejecting unit 29, and a control unit 50.

The image reading unit 21 is a part that reads an image in an original. The image reading unit 21 has an auto document feeder (ADF) 21*a* and an original image scanning device (scanner) 21*b*. The auto document feeder 21*a* carries an original placed on an original tray by a carrying mechanism and feeds it to the original image scanning device 21*b*. The image reading unit 21 can successively read images of a number of originals placed on the original tray. Such reading of original images is realized by cooperation of the auto document feeder 21*a* and the original image scanning device 21*b*. The original image scanning device 21*b* optically scans an original carried onto a contact glass by the auto document feeder 21*a* or an original put on the contact glass by the user and forms an image by reflection light from the original on the light receiving face of a CCD (Charge Coupled Device) sensor or the like, thereby reading an image of the original. The image reading unit 21 generates image data on the basis of a result of reading by the original image scanning device 21*b*.

The operation display unit 22 has a function as an operation unit of accepting an input operation of the user and a function as a display unit displaying various information to the user. The operation display unit 22 is configured by, for example, a liquid crystal display unit of a touch panel type and can accept an operation by the user and display information to the user. The operation unit can be configured by a mouse, a tablet, or the like, and can be constructed as a member different from the display unit.

The sheet supply unit 23 has a plurality of sheet housing units 23*a*. In the plurality of sheet housing units 23*a*, sheets of different sizes and different kinds can be housed. In the embodiment, the sheet 20 is, for example, a paper sheet. The sheet 20 is not limited to a paper sheet as long as resistance can be measured. When any of the sheet housing units 23*a* is selected on the basis of an instruction of a job, the sheet supply unit 23 supplies the sheet 20 from the selected sheet housing unit 23*a*. The job is entered by the user operating the operation display unit 22 or entered from an external device which can communicate with the image forming device 1 via a network. The sheet 20 is fed from the sheet housing unit 23*a* by driving a sheet supply roller (not illustrated) provided in correspondence with the sheet housing unit 23*a*. After that, the sheet 20 fed from the sheet housing unit 23*a* is carried along a sheet carriage path 10.

The sheet carriage path 10 is provided with a plurality of carriage rollers 12 for carrying the sheet 20. The sheet carriage path 10 is provided with a resist unit 14, a resistance measuring unit 16, and a charge eliminating unit 18. A sheet carrying unit 34 has the plurality of carriage rollers 12, the resist unit 14, the resistance measuring unit 16, and the charge eliminating unit 18 which are described above. The resist unit 14 is configured by using a pair of resist rollers. The pair of resist rollers is disposed in a state where they come into contact with each other by predetermined application pressure. The pair of resist rollers temporarily stops the sheet 20 which is carried along the sheet carriage path 10 and, after that, feeds the sheet 20 toward the transfer unit 27 at a predetermined timing. The predetermined timing is set in accordance with a timing when the toner image reaches the transfer unit 27. The pair of resist rollers rotates while sandwiching and supporting the sheet 20 to thereby feed the sheet 20 toward the transfer unit 27 and swings in a direction perpendicular to a sheet carriage direction Y during the feeding to thereby correct a positional deviation in the width direction of the sheet 20.

The sheet carriage path 10 extends from the sheet supply unit 23 to the sheet ejecting unit 29. The sheet ejecting unit 29 is provided with an ejection tray that receives a sheet, and the sheet 20 on which an image is formed is ejected onto the ejection tray.

An image forming device body 2 is provided with a reverse carriage path and a re-carriage path which are not illustrated. The reverse carriage path is a carriage path for turning over a sheet which passed through the transfer unit 27 and the fixing unit 28. The re-carriage path is a carriage path for carrying again the sheet which is turned over by the reverse carriage path toward the transfer unit 27.

A sheet detecting unit 30 is provided near the resist unit 14. In the case of carrying the sheet 20 fed from the sheet housing unit 23*a* by the carriage rollers 12, the sheet detecting unit 30 detects passage of the front end and the rear end of the sheet 20. The front end of the sheet 20 is a sheet end positioned on the downstream side in the sheet carriage direction Y, and the rear end of the sheet 20 is a sheet end positioned on the upstream side in the sheet carriage direction Y.

The sheet detecting unit 30 is configured by using, for example, a non-contact sensor or a contact sensor. As a non-contact sensor, an optical sensor of a reflective type or transmission type can be used. As a contact sensor, for example, a sensor having a movable sensor arm which is pressed against the front end of a sheet to set a sensor output to an on state and is apart from the rear end of the sheet to set a sensor output to an off state can be used.

The image forming unit 24 has four image formation units 26Y, 26M, 26C, and 26K for forming toner images of the colors of yellow (Y), magenta (M), cyan (C), and black (K). Each of the four image formation units 26Y, 26M, 26C, and 26K has a photosensitive drum, a charger, an exposure, a developer, a discharger, a drum cleaner, and the like. The image forming unit 24 forms toner images of the colors by controlling the operations of the image formation units 26Y, 26M, 26C, and 26K.

The image forming device 1 forms a toner image on the surface of the photosensitive drum of each of the image formation units 26Y, 26M, 26C, and 26K. A toner image is formed by process as described below. First, the surface of the photosensitive drum is charged by the charger. Next, the charged surface of the photosensitive drum is exposed by the exposure to eliminate charges, thereby forming an electrostatic latent image on the surface of the photosensitive drum. Subsequently, by supplying toner to the surface of the photosensitive drum by the developer, the electrostatic latent image is developed by adhesion of the toner. By the process, a toner image is formed on the surface of the photosensitive drum. At this time, a toner image of yellow is formed on the photosensitive drum of the image formation unit 26Y, a toner image of magenta is formed on the photosensitive drum of the image formation unit 26M, a toner image of cyan is formed on the photosensitive drum of the image formation unit 26C, and a toner image of black is formed on the photosensitive drum of the image formation unit 26K.

After forming the toner images of the surfaces of the photosensitive drums of the image formation units 26Y, 26M, 26C, and 26K as described above, the toner images of the colors are transferred sequentially to the surface of the intermediate transfer belt 25. The transfer of the toner images from the photosensitive drums to the intermediate transfer belt 25 is performed by a not-illustrated primary transfer roller. At this time, the toner images of the colors are transferred so as to be superimposed on the intermediate transfer belt 25. The transfer at this stage is called primary transfer. By the transfer, color toner images are formed on the intermediate transfer belt 25.

Next, the color toner images formed on the intermediate transfer belt 25 are transferred in a lump onto the sheet 20 by the transfer unit 27. The transfer at this stage is called secondary transfer. At the time of the secondary transfer, the sheet 20 is fed from the resist unit 14 to the transfer unit 27 in accordance with the timing that the toner image (hereinbelow, also simply called "image") reaches the transfer unit 27. By the operation, the toner image on the intermediate transfer belt 25 is transferred onto the sheet 20. As a result, the toner image is formed on the sheet 20. After that, the sheet 20 is sent to the fixing unit 28.

The fixing unit 28 is a part fixing an image on the sheet 20 on which the toner image is formed. The fixing unit 28 fixes the toner image on the sheet 20 by applying pressure and heating the sheet 20 carried through the transfer unit 27. The fixing unit 28 has a pair of rollers made by a fixing roller and a pressure roller. The fixing roller has therein a heater. The fixing roller and the pressure roller are disposed in a state where there are in pressure contact with each other, and a fixing nip part is formed in the pressure contact part. For the fixing nip part, the sheet 20 is fed to the fixing part 28 so that the sheet face on which the toner image is formed comes into contact with the fixing roller. Consequently, to the sheet 20 passing through the fixing unit 28, pressure force by the pressure roller and heat by the heater provided in the fixing roller are applied. As a result, the toners on the sheet 20 are heated and fused, and the fused tonners are pressure fixed on the sheet 20. The sheet 20 subjected to such fixing process is ejected to the sheet ejection unit 29.

In the case of ejecting the sheet 20 with its image formation face downward, the sheet 20 fed from the fixing unit 28 is led to a not-illustrated reverse carriage path and is ejected to the sheet ejecting unit 29 in a state where the sheet 20 is reversed by switchback carriage using the reverse carriage path. In the case of forming an image on both faces of the sheet 20, the sheet 20 subjected to formation of an image on its first face and fed from the fixing unit 28 is led to the not-illustrated reverse carriage path and, in a state where the sheet 20 is reversed by the switchback carriage using the reverse carriage path, the sheet 20 is sent to a not-illustrated re-carriage path. The sheet 20 is fed again to the transfer unit 27 and the fixing unit 28 through the re-carriage path and, after that, the sheet 20 is ejected to the sheet ejecting unit 29.

Figure 2:
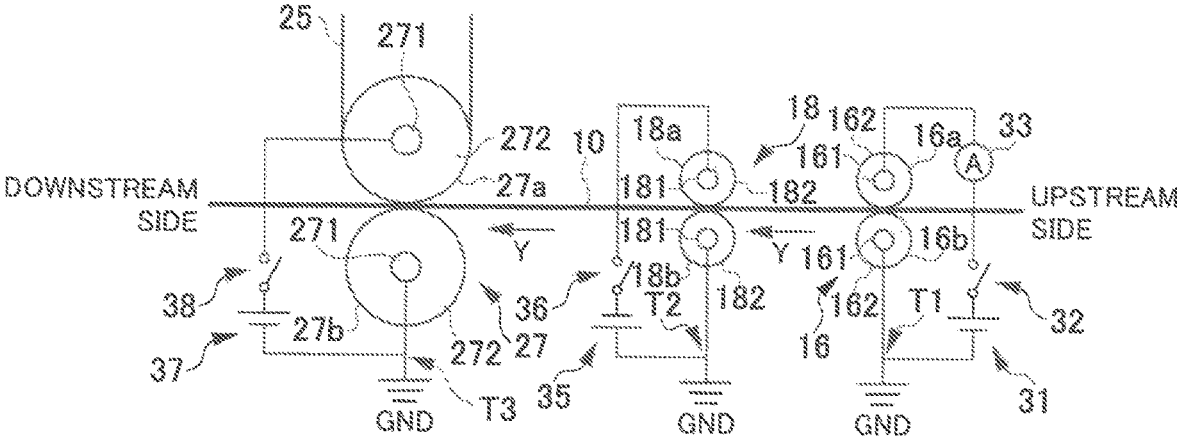
FIG. 2 is a schematic diagram illustrating an enlarged part of the image forming device of FIG. 1.
Figure 3:
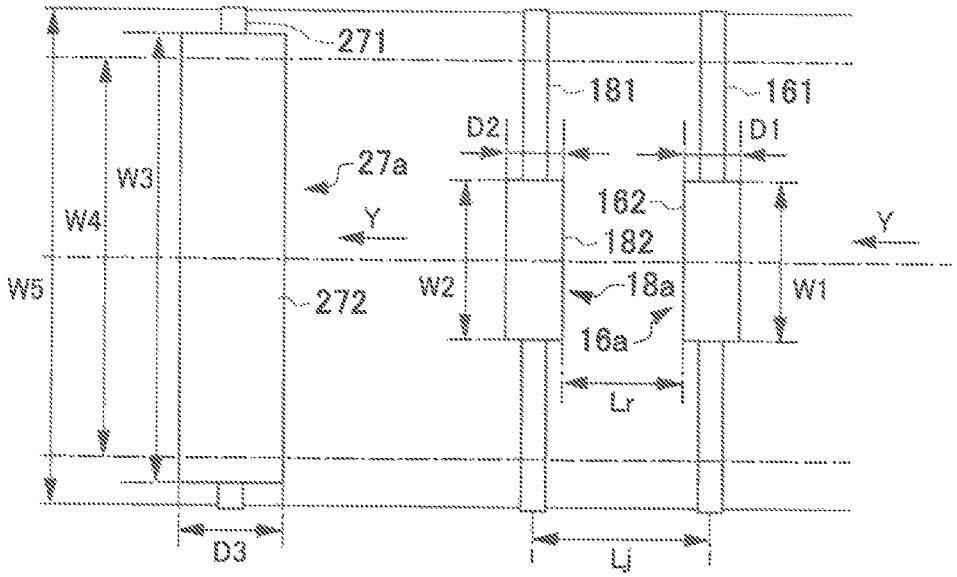
FIG. 3 is a plan view illustrating disposition of a resistance measuring unit, a charge eliminating unit, and a transfer unit illustrated in FIG. 2.

FIG. 2 is a schematic diagram of an enlarged part of the image forming device 1 illustrated in FIG. 1. FIG. 3 is a plan view illustrating disposition of the resistance measuring unit 16, the charge eliminating unit 18, and the transfer unit 27 illustrated in FIG. 2. FIG. 3 illustrates disposition of the units in the case of carrying the sheets 20 of various sizes in center reference. The case of carrying the sheet 20 in center reference denotes the case of carrying the sheet 20 so that the center position in the width direction of the sheet 20 becomes in the same reference position K regardless of the sheet sizes.

As illustrated in FIGS. 2 and 3, the resistance measuring unit 16 is disposed on the upstream side in the sheet carriage direction Y of the transfer unit 27. In the resistance measuring unit 16, a pair of resistance measurement rollers 16*a* and 16*b* is disposed. The pair of resistance measurement rollers 16*a* and 16*b* is provided as an example of a resistance measurement member for measuring the resistance of the sheet 20. Each of the resistance measurement rollers 16*a* and 16*b* is disposed in a direction perpendicular to the sheet carriage direction Y. Each of the resistance measurement rollers 16*a* and 16*b* is configured by a roller axis part 161 and a roller nip part 162. The roller axis part 161 is configured by, for example, a shaft made of metal, and the roller nip part 162 is configured by, for example, conductive resin. The roller nip part 162 is formed in a cylindrical shape and fixed by being fit in the roller axis part 161. The sheet 20 carried along the sheet carriage path 10 is sandwiched by the roller nip parts 162. A roller diameter D1 and a roller width W1 of each of the resistance measurement rollers 16*a* and 16*b* are specified by the diameter and the width of the roller nip part 162. The roller width W1 corresponds to the nip width of the sheet by the pair of resistance measurement rollers 16*a* and 16*b*. The center position in the width direction of the roller nip part 162 is positioned in the above-described reference position K.

The pair of resistance measurement rollers 16*a* and 16*b* is a component of an electric circuit for resistance measurement which will be described hereinafter (hereinafter, also called "resistance measurement circuit").

First, to the pair of resistance measurement rollers 16*a* and 16*b*, a power supply 31 for resistance measurement is electrically connected. The positive electrode of the power supply 31 for resistance measurement is connected to the resistance measurement roller 16*a* on the upper side. Between the positive electrode of the power supply 31 for resistance measurement and the resistance measurement roller 16*a* on the upper side, a switch 32 and an ammeter 33 are provided. On the other hand, the negative electrode of the power supply 31 for resistance measurement is connected to a connection point T1. The connection point T1 is provided between the resistance measurement roller 16*b* on the lower side and a ground GND. The power supply 31 for resistance measurement and the switch 32 construct a first voltage applying unit applying voltage for resistance measurement to the pair of resistance measurement rollers 16*a* and 16*b* as the resistance measurement members.

In the above-described resistance measurement circuit, when the sheet 20 is sandwiched between the pair of resistance measurement rollers 16*a* and 16*b* and the switch 32 is turned on, voltage is applied to the pair of resistance measurement rollers 16*a* and 16*b* and the sheet 20. At this time, DC voltage is applied to the pair of resistance measurement rollers 16*a* and 16*b* and the sheet 20. That is, the voltage application method in the resistance measuring unit 16 is a roller sandwiching and supporting method and a DC superposition method. A positive voltage is applied to the resistance measurement roller 16*a* on the upper side. To the sheet 20 sandwiched by the pair of resistance measurement rollers 16*a* and 16*b*, current flows according to the resistance of the sheet 20. Therefore, by measuring the current flowing to the sheet 20 by the ammeter 33, the resistance of the sheet 20 can be measured. Concretely, when resistance (unit: ohm) of the sheet 20 is Rs, voltage (unit: volt) applied to the pair of resistance measurement rollers 16*a* and 16*b* by the power supply 31 for resistance measurement is V1, current (unit: ampere) detected by the ammeter 33 is I, resistance (unit: ohm) of the resistance measurement roller 16*a* is Rr1, and resistance (unit: ohm) of the resistance measurement roller 16*b* is Rr2, the resistance (volume resistance) of the sheet 20 can be obtained by a math formula "Rs=V1/I−Rr1−Rr2". In this case, the voltage V1 corresponds to the voltage for resistance measurement.

The charge eliminating unit 18 is disposed between the transfer unit 27 and the resistance measuring unit 16 in the sheet carriage direction Y. Consequently, the sheet 20 carried along the sheet carriage path 10 is fed, sequentially through the resistance measuring unit 16 and the charge eliminating unit 18, to the transfer unit 27. In the charge eliminating unit 18, a pair of charge elimination rollers 18*a* and 18*b* is disposed. The pair of charge elimination rollers 18*a* and 18*b* is provided as an example of a charge elimination member for eliminating charges residual in the sheet 20. Each of the charge elimination rollers 18*a* and 18*b* is disposed in a direction perpendicular to the sheet carriage direction Y. Each of the charge elimination rollers 18*a* and 18*b* is constructed by a roller axis part 181 and a roller nip part 182. The roller axis part 181 is constructed by, for example, a shaft made of metal, and the roller nip part 182 is constructed by, for example, a conductive resin. The roller nip part 182 is formed in a cylindrical shape and fixed by being fit in the roller axis part 181. The sheet 20 carried along the sheet carriage path 10 is sandwiched by the roller nip parts 182. The roller diameter D2 and the roller width W2 of each of the charge elimination rollers 18*a* and 18*b* are specified by the diameter and the width of the roller nip part 182. The roller width W2 corresponds to the nip width of the sheet by the pair of charge elimination rollers 18*a* and 18*b*. The center position in the width direction of the roller nip part 182 is positioned in the above-described reference position K. The roller diameter D2 of the charge elimination rollers 18*a* and 18*b* is set to the same as the roller diameter D1 of the above-described resistance measurement rollers 16*a* and 16*b*. The roller distance between the resistance measurement rollers 16*a* and 16*b* and the charge elimination rollers 18*a* and 18*b* in the sheet carriage direction Y is set to Lr (mm). The distance between the roller axes of the resistance measurement rollers 16*a* and 16*b* and the charge elimination rollers 18*a* and 18*b* in the sheet carriage direction Y is set to Lj (mm).

The pair of charge elimination rollers 18*a* and 18*b* forms an electric circuit for charge elimination (hereinbelow, also called "charge elimination circuit") which will be described hereinafter.

First, a power supply 35 for charge elimination is electrically connected to the pair of charge elimination rollers 18*a* and 18*b*. The negative electrode of the power supply 35 for charge elimination is connected to the upper-side charge elimination roller 18*a*. A switch 36 is provided between the negative electrode of the power supply 35 for charge elimination and the upper-side charge elimination roller 18*a*. On the other hand, the positive electrode of the power supply 35 for charge elimination is connected to a connection point T2. The connection point T2 is provided between the lower-side charge elimination roller 18*b* and the ground GND. The power supply 35 for charge elimination and the switch 36 construct a second voltage applying unit that applies the voltage for charge elimination to the pair of charge elimination rollers 18*a* and 18*b* as a charge elimination member. The voltage for charge elimination is a voltage of reverse bias of the above-described voltage for resistance measurement.

In the above-described charge elimination circuit, when the sheet 20 is sandwiched between the pair of charge elimination rollers 18*a* and 18*b* and the switch 36 is turned on, voltage is applied to the pair of charge elimination rollers 18*a* and 18*b* and the sheet 20. At this time, DC voltage is applied to the pair of charge elimination rollers 18*a* and 18*b* and the sheet 20. That is, the voltage applying method in the charge eliminating unit 18 is a roller sandwiching and supporting method and a DC superposition method. To the upper-side charge elimination roller 18*a*, a negative voltage, that is, a voltage of the reverse voltage of the voltage V1 is applied. By the above, charges applied to the sheet 20 by the pair of resistance measurement rollers 16*a* and 16*b* can be eliminated.

The transfer unit 27 is disposed on the downstream side in the sheet carriage direction Y of the charge eliminating unit 18. In the transfer unit 27, a pair of transfer rollers 27*a* and 27*b* is disposed. The pair of transfer rollers 27*a* and 27*b* is provided as an example of a transfer member for transferring a toner image from the intermediate transfer belt 25 to the sheet 20. Each of the transfer rollers 27*a* and 27*b* is disposed in a direction perpendicular to the sheet carriage direction Y. Each of the transfer rollers 27*a* and 27*b* is constructed by a roller axis part 271 and a roller nip part 272. The roller axis part 271 is constructed by, for example, a shaft made of metal and the roller nip part 272 is formed in a cylindrical shape and fixed by being fit in the roller axis part 271. The sheet 20 carried along the sheet carriage path 10 is sandwiched by the roller nip parts 272. The roller diameter D3 and the roller width W3 of each of the transfer rollers 27*a* and 27*b* are specified by the diameter and the width of the roller nip part 272. The center position in the width direction of the roller nip part 272 is positioned in the above-described reference position K. The roller diameter D3 of the transfer rollers 27*a* and 27*b* is set to be larger than the roller diameter D1 of the above-described resistance measurement rollers 16*a* and 16*b*. The roller width W3 of the transfer rollers 27*a* and 27*b* is set to be larger than the roller width W1 of the above-described resistance measurement rollers 16*a* and 16*b* and larger than the maximum sheet width W4 of the sheet which can be carried in the sheet carriage path 10. The width W5 in FIG. 3 indicates a mechanical limit width in the sheet carriage path 10 of the image forming device 1, and the roller width W3 of the transfer rollers 27*a* and 27*b* is set to be smaller than the width W5.

The pair of transfer rollers 27*a* and 27*b* is a component of an electric circuit for transfer which will be described hereinafter (hereinafter, also called "transfer circuit").

First, a power supply 37 for transfer is electrically connected to the pair of transfer rollers 27*a* and 27*b*. The positive electrode of the power supply 37 for transfer is connected to the transfer roller 27*a* on the upper side. A switch 38 is provided between the positive electrode of the power supply 37 for transfer and the transfer roller 27*a* on the upper side. On the other hand, the negative electrode of the power supply 37 for transfer is connected to a connection point T3. The connection point T3 is provided between the transfer roller 27*a* on the lower side and the ground GND. The power supply 37 for transfer and the switch 38 construct a transfer voltage applying unit which applies voltage for transfer to the pair of transfer rollers 27*a* and 27*b* as a transfer member.

In the above-described transfer circuit, when the sheet 20 is sandwiched between the pair of transfer rollers 27*a* and 27*b* and the switch 38 is turned on, voltage is applied to the pair of transfer rollers 27*a* and 27*b* and the sheet 20. At this time, DC voltage is applied to the pair of transfer rollers 27*a* and 27*b*. Positive voltage is applied to the transfer roller 27*a* on the upper side. The positive voltage is a voltage for transfer.

Control Configuration of Image Forming Device

Figure 4:
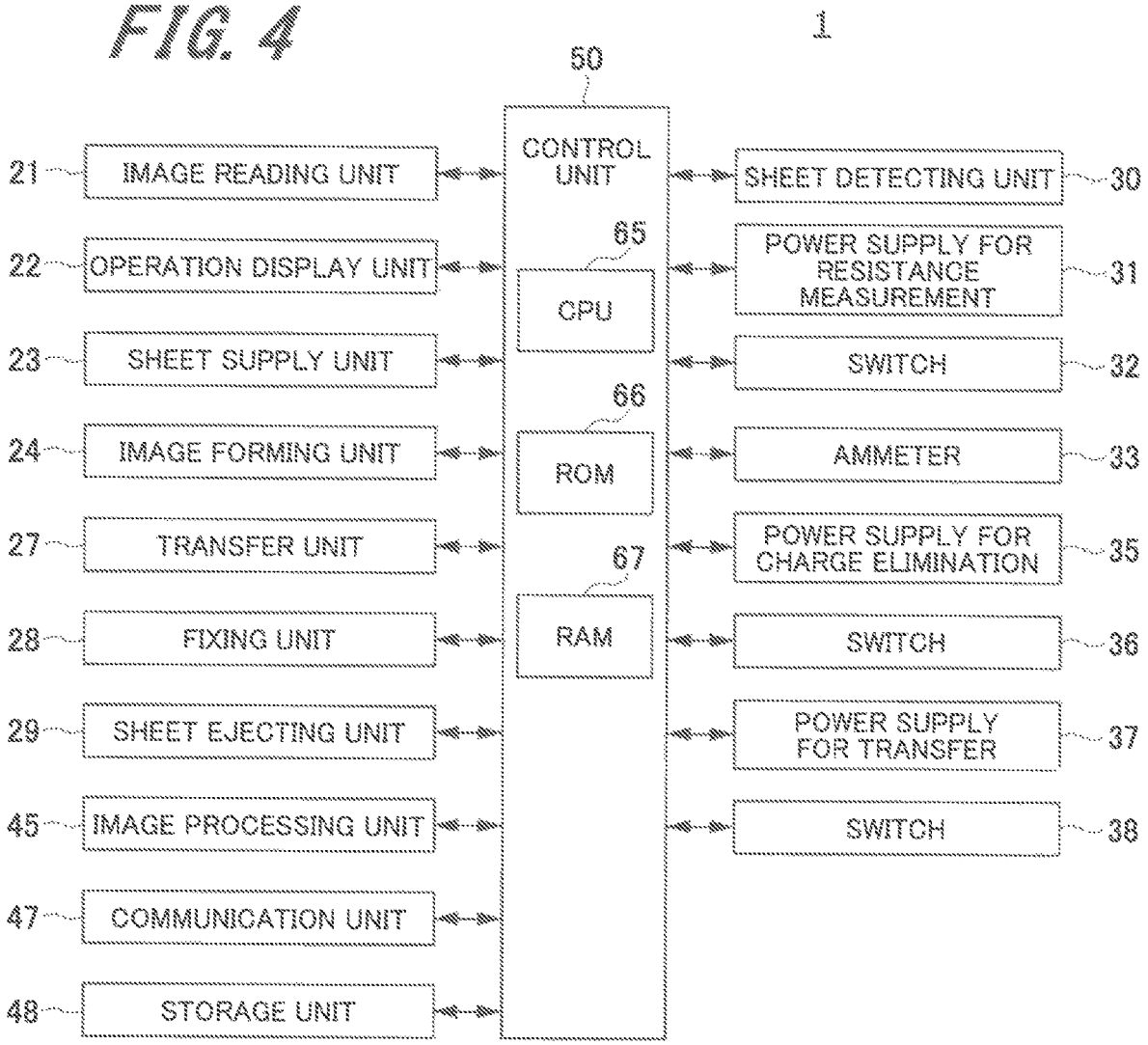
FIG. 4 is a block diagram illustrating a configuration example of a control system of the image forming device according to an embodiment of the present invention.

FIG. 4 is a block diagram illustrating a configuration example of a control system of the image forming device according to an embodiment of the present invention.

As illustrated in FIG. 4, the image forming device 1 has, in addition to the image reading unit 21, the operation display unit 22, the sheet supply unit 23, the image forming unit 24, the transfer unit 27, the fixing unit 28, the sheet ejecting unit 29, the sheet detecting unit 30, the power supply 31 for resistance measurement, the switches 32, 36, and 38, the ammeter 33, the sheet carrying unit 34, the power supply 35 for charge elimination, the power supply 37 for transfer, and the control unit 50 which are described above, an image processing unit 45, a communication unit 47, and a storage unit 48.

The control unit 50 has a CPU (Central Processing Unit) 65, a ROM (Read Only Memory) 66, and a RAM (Random Access Memory) 67. The control unit 50 controls the operations of the units of the image forming device 1 in a centralized manner by reading a predetermined process program stored in the ROM 66 by the CPU 65, expanding the program to the RAM 67, and executing the expanded program by the CPU 65. The control unit 50 controls application of the voltage for resistance measurement by using the power supply 31 for resistance measurement and the switch 32 and controls application of the voltage for charge elimination by using the power supply 35 for charge elimination and the switch 36. That is, the control unit 50 has the function as the voltage control unit. The function as the voltage control unit is realized by controlling the turn-on/off timings of the switch 32 and the turn-on/off timings of the switch 36 by the control unit 50.

The image processing unit 45 performs a predetermined image process on image data read by the image reading unit 21 or image data received via the communication unit 47. The predetermined image process includes, for example, a tone correcting process, a halftone process, and the like. The tone correcting process is a process of correcting a tone value of each of pixels of image data so that the density of an image formed on a sheet becomes equal to target density. The halftone process is, for example, an error diffusion process, a screen process using a systematic dithering method, and the like.

The communication unit 47 performs communication with an external device on a not-illustrated network, thereby transmitting/receiving various data between the image forming device 1 and the external device. The image forming device 1 is connected to a communication network such as LAN (Local Area Network) or WAN (Wide Area Network) via the communication unit 47 and transmits/receives various data to/from an external device (for example, a personal computer) via the communication network. The communication unit 47 receives, for example, PDL data transmitted from an external device. The PDL data is data described in the PDL (Page Description Language). The image processing unit 45 converts the PDL data to image data of the bit map format by performing rasterizing process on the PDL data.

The storage unit 48 is used to store various information (data) necessary for operating the image forming device 1 and controlling the operation. The storage unit 48 is, for example, a nonvolatile semiconductor memory (so-called flash memory), an HDD (Hard Disk Drive), an SSD (Solid State Drive), or the like.

Voltage Application State at the Time of Resistance Measurement

Next, a voltage application state at the time of measuring resistance of the sheet 20 in the resistance measuring unit 16 will be described.

Generally, since the resistance value of the sheet 20 is large, in the case of measuring the resistance of the sheet 20 by sandwiching the sheet 20 between the pair of resistance measurement rollers 16*a* and 16*b*, the resistance of the sheet 20 cannot be measured accurately without applying a voltage which is high to a certain degree to the pair of resistance measurement rollers 16*a* and 16*b*. In experiments of the inventors of the present invention, when the voltage for resistance measurement is 100V, in many cases, the resistance of the sheet 20 cannot be measured. When the voltage for resistance measurement is 200V, the resistance of the sheet 20 can be measured depending on environments. When the voltage for resistance measurement is 500V, the resistance of the sheet 20 can be measured. Also in the case where the voltage for resistance measurement is 1000V, the resistance of the sheet 20 can be measured. However, when the voltage for resistance measurement is 1000V, if the resistance of the sheet 20 as an object to be measured is small, current largely flows to the sheet 20 between the pair of resistance measurement rollers 16*a* and 16*b*, so that the power supply 31 for resistance measurement having capacity which is large to a degree that the flow of the current can be allowed has to be prepared. Consequently, increase in cost of the image forming device 1 is concerned. In the embodiment, therefore, the voltage for resistance measurement is set to 500V as a preferable example.

Figure 5:
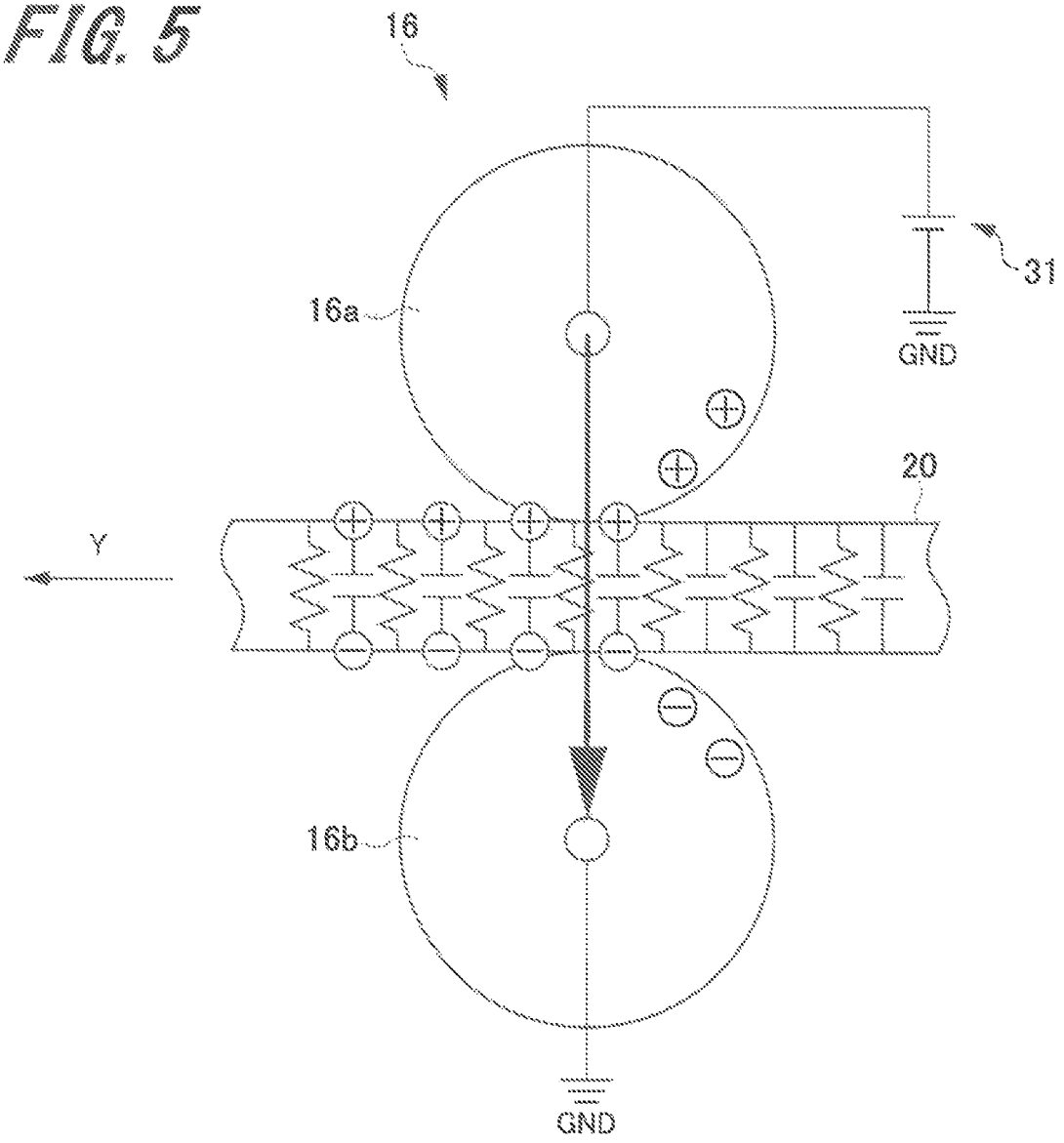
FIG. 5 is a schematic diagram illustrating a state where voltage is applied to a pair of resistance measurement rollers by a power supply for resistance measurement while sandwiching a sheet between the pair of resistance measurement rollers.

FIG. 5 is a schematic diagram illustrating a state where voltage is applied to the pair of resistance measurement rollers 16*a* and 16*b* by the power supply 31 for resistance measurement while sandwiching the sheet 20 between the pair of resistance measurement rollers 16*a* and 16*b*.

As illustrated in FIG. 5, the sheet 20 such as paper sheet is generally made by a resistance component and a capacitance component. Consequently, when voltage is applied to the pair of resistance measurement rollers 16*a* and 16*b* by the power supply 31 for resistance measurement, positive charges from the resistance measurement roller 16*a* on the upper side and negative charges from the resistance measurement roller 16*b* on the lower side are given to the sheet 20. As a result, the charges are accumulated in the sheet 20. When the sheet 20 is fed to the transfer unit 27 in such a state, due to the action of the charges, a trouble such as poor transfer occurs at the time of transferring a toner image.

The applicant of the present invention discloses the following technical matters (1) and (2) in the specification of Japanese Unexamined Patent Application No. 2020-030158.

Figure 6:
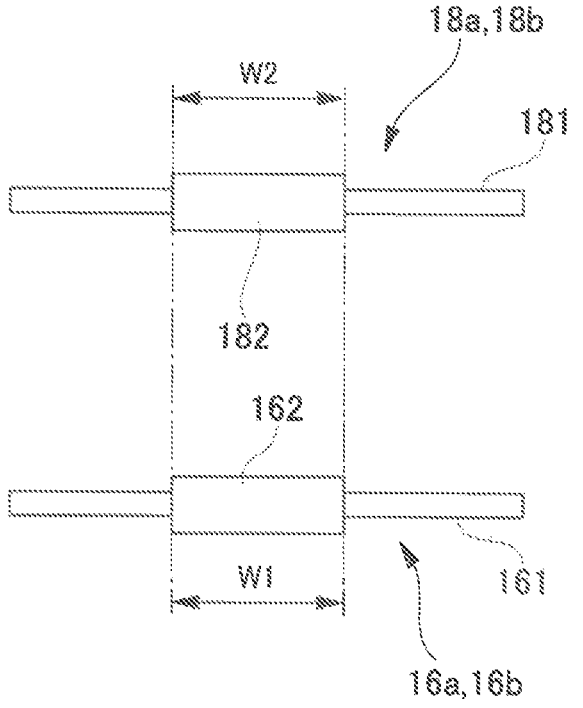
FIG. 6 is a schematic diagram illustrating an example in which the width of the resistance measurement roller and that of a charge elimination roller are set to the same.

(1) As illustrated in FIG. 6, the relation between the roller width W1 as the nip width of the sheet by the pair of resistance measurement rollers 16*a* and 16*b* and the roller width W2 as the nip width of the sheet by the pair of charge elimination rollers 18*a* and 18*b* is set to W1=W2.

Figure 7:
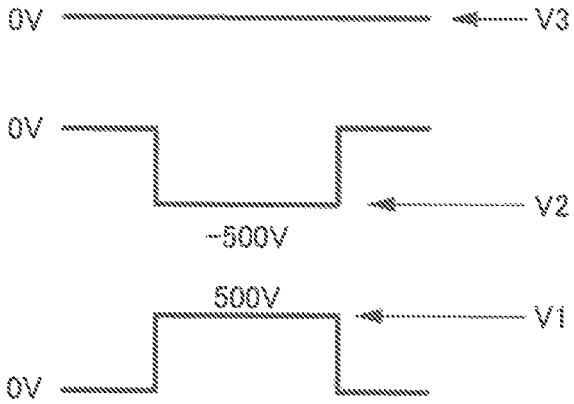
FIG. 7 is a diagram illustrating a setting example of a voltage for resistance measurement and a voltage for charge elimination.

(2) As illustrated in FIG. 7, the voltage V1 for resistance measurement is set to 500V, and the voltage V2 for charge elimination is set to the reverse vias of 500V, that is, −500V.

By the setting, as illustrated in FIG. 7, the surface potential V3 of the sheet after charge elimination can be set to substantially 0V. Therefore, the residual charges in the sheet 20 can be eliminated, and occurrence of a trouble in the transfer unit 27 can be suppressed.

The inventors of the present invention further examined the invention described in the specification of Japanese Unexamined Patent Application No. 2020-030158 and, as a result, obtained the knowledge that a new problem as described hereinafter exists.

Figure 8:
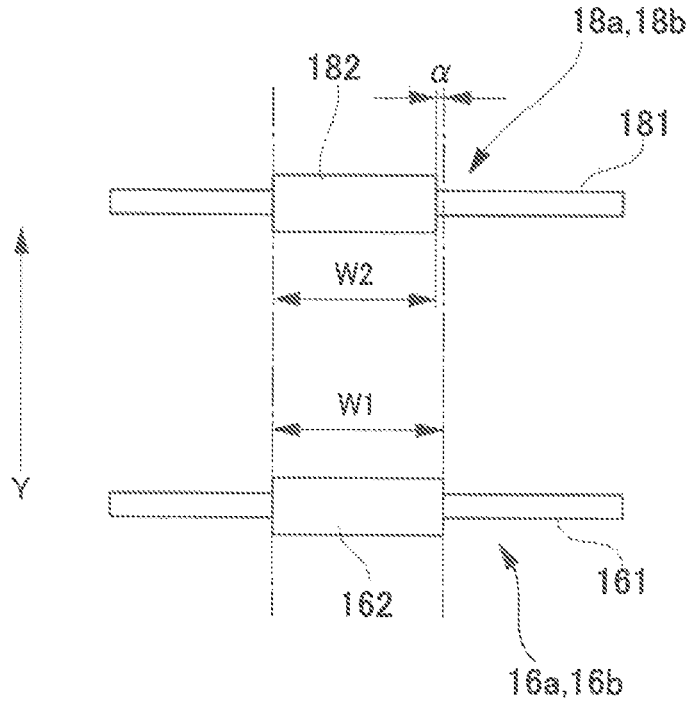
FIG. 8 is a schematic diagram illustrating a state where a deviation occurs in the positions of roller ends due to the difference between the width of the resistance measurement roller and that of the charge elimination roller.
Figure 9:
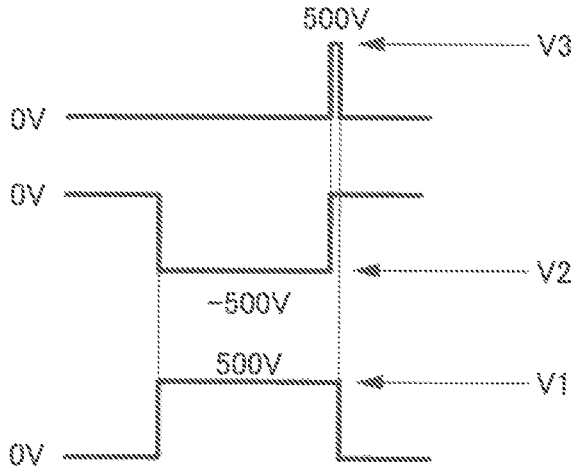
FIG. 9 is a diagram for explaining the principle of occurrence of poor transfer by a position deviation of the roller ends illustrated in FIG. 8.

First, it is difficult to process the rollers so that the roller width W1 of the roller nip part 162 in the pair of resistance measurement rollers 16*a* and 16*b* and the roller width W2 of the roller nip part 182 in the pair of charge elimination rollers 18*a* and 18*b* become strictly the same. Consequently, for example, as illustrated in FIG. 8, when the roller width W2 of the charge elimination rollers 18*a* and 18*b* is shorter than the roller width W1 of the resistance measurement rollers 16*a* and 16*b*, even if one end of the roller nip part 162 and one end of the roller nip part 182 are disposed so as to be aligned, a deviation α occurs in the positions of the other ends. As a result, as illustrated in FIG. 9, even when the relation of the voltage V1 for resistance measurement and the voltage V2 for charge elimination is set as the above-described matter (2), the surface potential V3 of the sheet after charge elimination becomes locally 500V due to the positional deviation α, and poor transfer such as a transfer streak is caused by the residual charges of 500V. The transfer streak is a gray-shade part which appears in a streak shape along the sheet carriage direction Y when a toner image is transferred to the sheet 20. A transfer streak appears as a low-concentration part in a narrow elongated streak shape along the sheet carriage direction Y at the time of forming a solid image of high density on the sheet 20.

Figure 10:
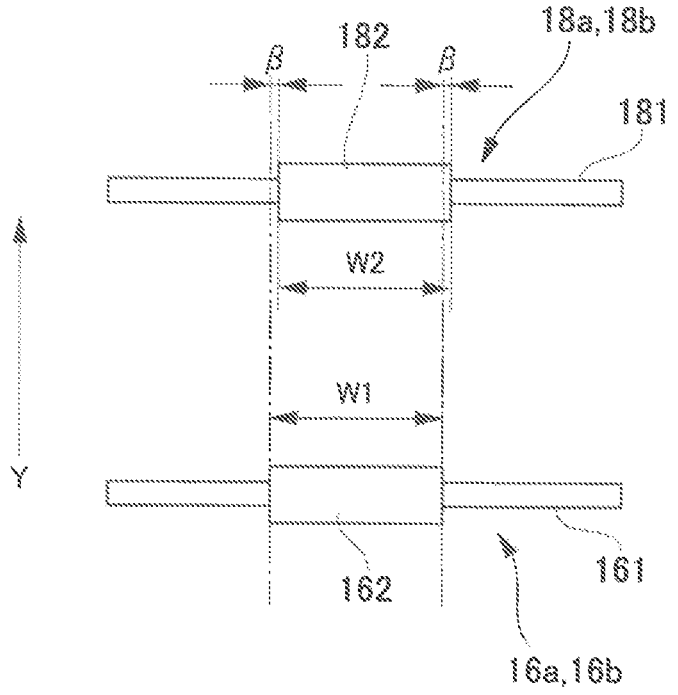
FIG. 10 is a schematic diagram illustrating a state where a deviation occurs between the attachment position of the resistance measurement roller and that of the charge elimination roller.
Figure 11:
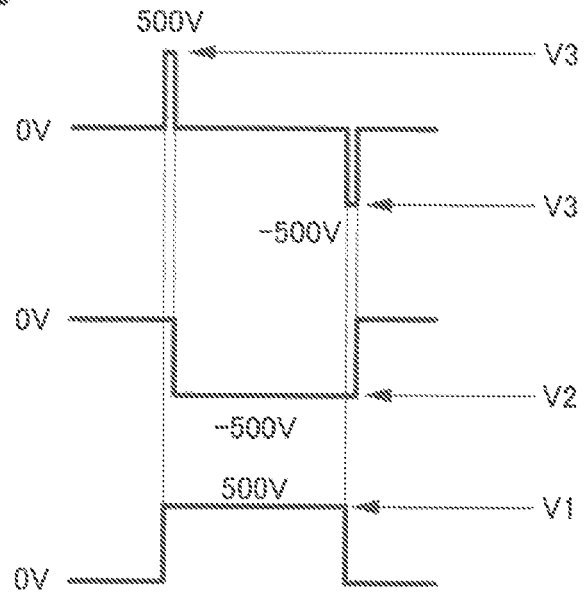
FIG. 11 is a diagram for explaining the principle of occurrence of poor transfer due to a deviation between the attachment position of the resistance measurement roller and that of the charge elimination roller.

On the other hand, even if the rollers can be processed so that the roller width W1 of the resistance measurement rollers 16*a* and 16*b* and the roller width W2 of the charge elimination rollers 18*a* and 18*b* become the same, as illustrated in FIG. 10, there is a case that a deviation β occurs in the positions between the roller nip parts 162 and 182 in the direction perpendicular to the sheet carriage direction Y. In this case, as illustrated in FIG. 11, even when the relation between the voltage V1 for resistance measurement and the voltage V2 for charge elimination is set as described in the above matter (2), the surface potential V3 of the sheet after charge elimination locally becomes 500V or −500V due to the positional deviation β. Due to the residual charge of 500V or −500V, poor transfer such as transfer streak occurs.

In the embodiment of the present invention, therefore, the configuration satisfying the following requirements (A) and (B) is employed.

(A) In a direction perpendicular to the sheet carriage direction Y, the width of a charge elimination region by the charge eliminating unit 18 is wider than that of a charged region by the resistance measuring unit 16.

(B) The absolute value of the voltage V2 for charge elimination is smaller than the absolute value of the voltage V1 for resistance measurement.

The charged region is a region in which charges are accumulated by the resistance measuring unit 16 in the case of measuring the resistance of the sheet 20 by the resistance measuring unit 16. The width of the charged region is specified by the nip width of the sheet by the pair of resistance measurement rollers 16*a* and 16*b*, that is, the roller width W1 of the roller nip part 162. On the other hand, the charge elimination region is a region of eliminating charges by the charge eliminating unit 18 in the case of eliminating the charges of the sheet 20 by the charge eliminating unit 18. The width of the charge elimination region is specified by the nip width of the sheet by the pair of charge elimination rollers 18*a* and 18*b*, that is, the roller width W2 of the roller nip part 182.

Figure 12:
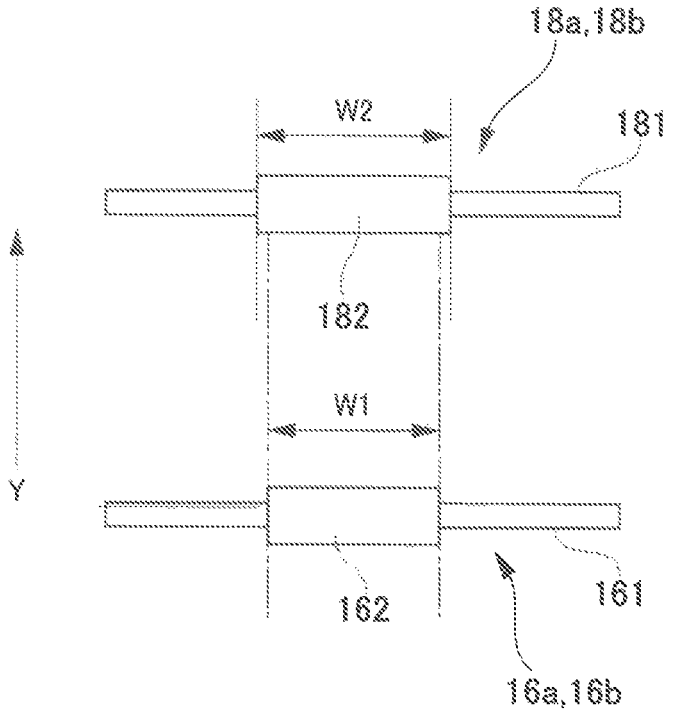
FIG. 12 is a schematic diagram illustrating the size relation between the width of the resistance measurement roller and that of the charge elimination roller in an embodiment of the present invention.

Therefore, in the embodiment of the present invention, as illustrated in FIG. 12, in a direction perpendicular to the sheet carriage direction Y, the roller width W2 corresponding to the nip width of the sheet by the pair of charge elimination rollers 18*a* and 18*b* is set wider than the roller width W1 corresponding to the nip width of the sheet by the pair of resistance measurement rollers 16*a* and 16*b*. The size relations between the roller width W2 and the roller width W1 are maintained even when the process dimensions and attachment dimensions of the rollers 16*a*, 16*b*, 18*a*, and 18*b* vary with an error (tolerance) which can be allowed in designing. The difference between the roller width W2 and the roller width W1 is at least larger than 0 mm, preferably, 0.3 mm or larger, more preferably, 0.5 mm or larger, and further more preferably, 0.7 mm or larger.

Figure 13:
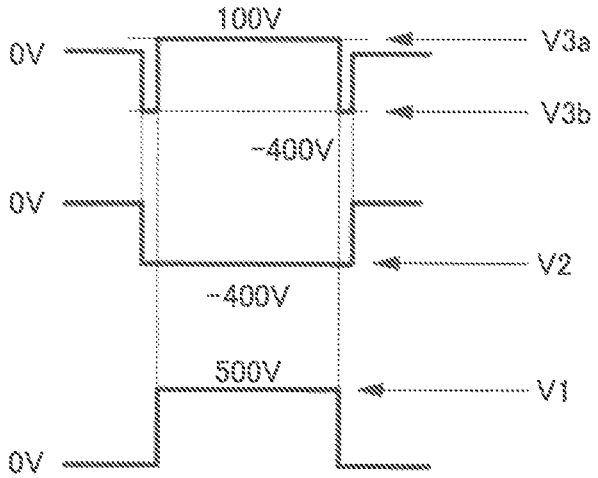
FIG. 13 is a diagram for explaining a first setting example of the voltage for resistance measurement and the voltage for charge elimination in an embodiment of the present invention.

In the embodiment of the present invention, as one preferable example (hereinbelow, called "first form example"), as illustrated in FIG. 13, the voltage V1 for resistance measurement is set to 500V, and the voltage V2 for charge elimination is set to −400V. In this case, the surface potential of the sheet after the charge elimination is divided into the part of 100V and the part of −400V. Concretely, a surface potential V3*a* of the part on the inside of the roller width W1 becomes 100V, and a surface potential V3*b* of the part on the outside of the roller width W1 and on the inside of the roller width W2 becomes −400V. That is, there are residual charges in the sheet after charge elimination. The residual charge of 100V is small to a degree that no poor transfer occurs. The residual charge of −400V is smaller than the residual charge (500V) illustrated in FIG. 9. Therefore, occurrence of poor transfer (such as a transfer streak) by residual charges can be suppressed.

Figure 14:
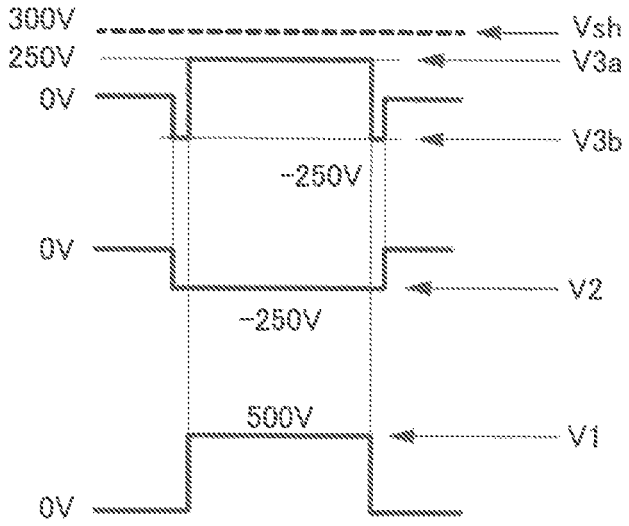
FIG. 14 is a diagram for explaining a second setting example of the voltage for resistance measurement and the voltage for charge elimination in an embodiment of the present invention.

In the embodiment of the present invention, as a more preferable example (hereinbelow, called "second form example"), the absolute value of the voltage V2 for charge elimination is set to the half of the absolute value of the voltage V1 for resistance measurement. As a concrete numerical example, as illustrated in FIG. 14, the voltage V1 for resistance measurement is set to 500V, and the voltage V2 for charge elimination is set to −250V. In this case, the surface potential of the sheet after charge elimination is divided into the part of 250V and the part of −250V. Concretely, the surface potential V3*a* of the part on the inside of the roller width W1 becomes 250V, and the surface potential V3*b* of the part on the outside of the roller width W1 and on the inside of the roller width W2 becomes −250V. In the second form example, the absolute value of the charges remaining in the sheet after the charge elimination becomes smaller than that in the first form example. Therefore, occurrence of poor transfer (such as a transfer streak) due to the residual charges can be suppressed more effectively. In the second form example, as illustrated in FIG. 14, a threshold voltage Vsh at which poor transfer occurs in the transfer unit 27 is larger than the difference between the absolute value of the voltage V1 for resistance measurement and the absolute value of the voltage V2 for charge elimination. Concretely, the threshold voltage Vsh is 300V and the difference between the first absolute value of the voltage V1 for resistance measurement and the absolute value of the voltage V2 for charge elimination is 250V. Consequently, charges remaining in the sheet after charge elimination can be suppressed to the level that no influence is exerted on the transfer in the transfer unit 27.

Figure 15:
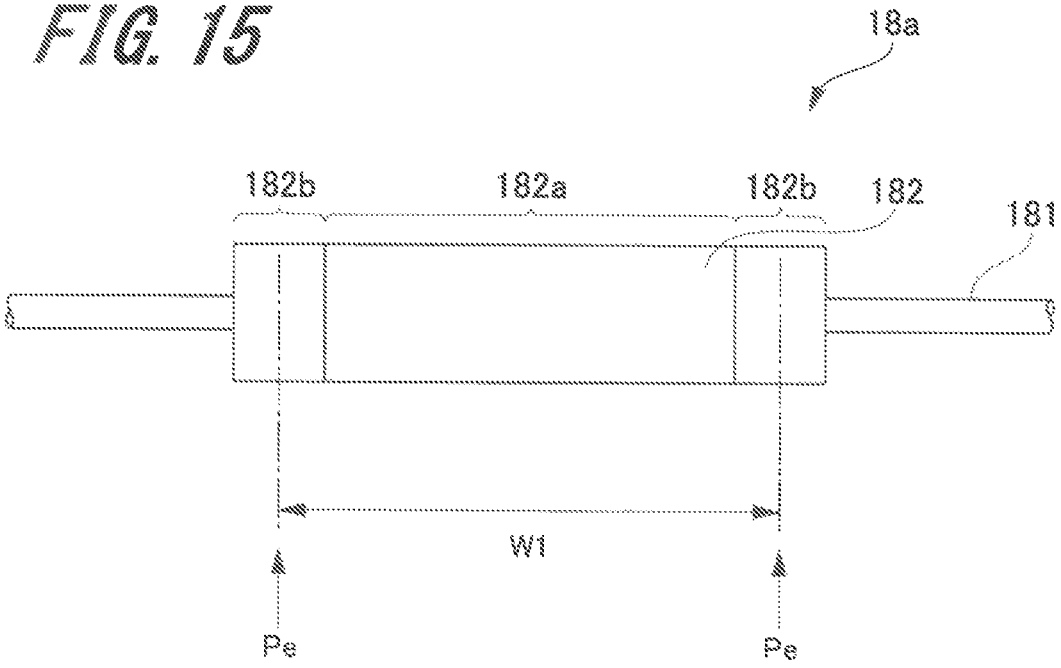
FIG. 15 is a schematic diagram for explaining the configuration of a charge elimination roller according to an embodiment of the present invention.

FIG. 15 is a schematic diagram for explaining the configuration of the charge elimination roller 18*a* according to the embodiment of the present invention. As illustrated in FIG. 15, the charge elimination roller 18*a* has the roller axis part 181 and the roller nip part 182. The roller nip part 182 has a first roller part 182*a* and a second roller part 182*b*. The first roller part 182*a* is a part having first electric resistance, and the second roller part 182*b* is a part having second electric resistance higher than the first electric resistance. The electric resistance of the first roller part 182*a* and that of the second roller part 182*b* are electric resistance between the axis of the roller and the outer peripheral face of the roller in the radius direction of the roller.

The first roller part 182*a* is disposed on the roller center side of the roller nip part 182 more than the second roller part 182*b* in the center axis direction of the roller axis part 181 (hereinbelow, also called "roller center-axis direction"), and the second roller parts 182*b* are disposed on the roller end sides of the roller nip part 182 more than the first roller part 182*a* in the roller center-axis direction. The second roller parts 182*b* are disposed at both ends of the roller nip part 182. In the roller center-axis direction as a direction perpendicular to the sheet carriage direction Y, both end positions Pe of the resistance measurement rollers 16*a* and 16*b* having the roller width W1 are disposed in the region of the second roller part 182*b* in the charge elimination roller 18*a*, more concretely, in the center position of the second roller part 182*b*.

The above-described configuration of the charge elimination roller 18*a* may be applied to the charge elimination roller 18*b*. In the embodiment, as illustrated in FIG. 2, the charge elimination roller 18*a* is connected to the negative electrode of the power supply 35 for charge elimination, and the charge elimination roller 18*b* is connected to the ground GND. Consequently, the charge elimination roller 18*b* may be configured by a roller in which electric resistance is uniform in the roller full width. For example, the entire charge elimination roller 18*b* may be configured by a roller made of metal.

Figure 16:
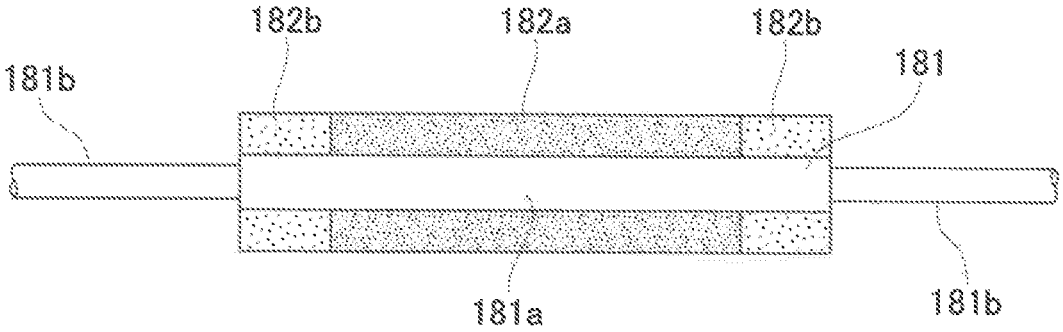
FIG. 16 is a schematic diagram illustrating a first example of the structure of the charge elimination roller.
Figure 17:
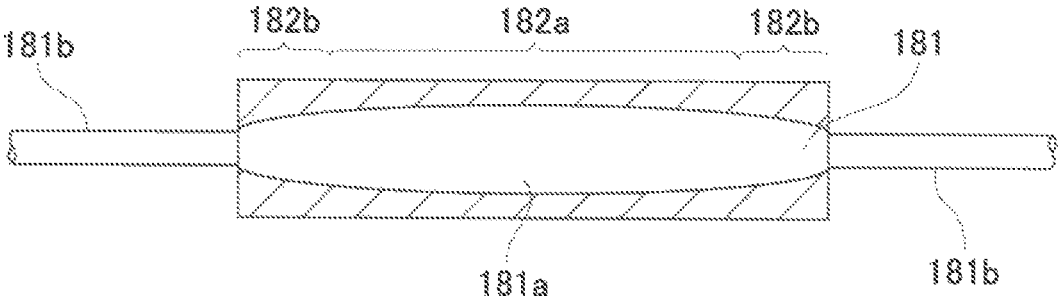
FIG. 17 is a schematic diagram illustrating a second example of the structure of the charge elimination roller.

In the configuration of the charge elimination roller 18*a*, as a concrete roller structure for making the first and second roller parts 182*a* and 182*b* parts having electric resistances which are different from each other, a structure illustrated in FIG. 16 or a structure illustrated in FIG. 17 is considered.

In FIG. 16, the roller axis part 181 integrally has a large-diameter axis part 181*a* and a small-diameter axis part 181*b*. The small-diameter axis part 181*b* extends from both ends of the large-diameter axis part 181*a* toward the outside of the roller center-axis direction. The roller nip part 182 has the same roller width as the large-diameter axis part 181*a*. The roller nip part 182 is fixed to the large-diameter axis part 181*a*. The roller nip part 182 integrally has the first roller part 182*a* and the second roller part 182*b*. Each of the first and second roller parts 182*a* and 182*b* is made of a material obtained by mixing insulating resin as a base with conductive filler. The mixing ratio of the conductive filler in the first roller part 182*a* is higher than that of the conductive filler in the second roller part 182*b*. Consequently, the electric resistance of the first roller part 182*a* is lower than that of the second roller part 182*b*.

On the other hand, in FIG. 17, the roller axis part 181 integrally has the large-diameter axis part 181*a* and the small-diameter axis part 181*b*. The large-diameter axis part 181*a* is formed in a radial crown shape. The radial crown shape is a roller shape whose center part in the roller center-axis direction is set as the top and forming gentle circular arc shapes from the top towards both ends in the roller center-axis direction. The small-diameter axis parts 181*b* extend from both ends of the large-diameter axis part 181*a* toward the outside in the roller center-axis direction. The roller nip part 182 has the roller width which is the same as that of the large-diameter axis part 181*a*. The roller nip part 182 is fixed to the large-diameter axis part 181*a*. The roller nip part 182 integrally has the first roller part 182*a* and the second roller part 182*b*. The outside diameter of the roller nip part 182 is constant in the roller width direction. The inside diameter of the roller nip part 182 continuously changes according to the radial crown shape as the outer peripheral shape of the large-diameter axis part 181*a*. Consequently, the outside diameter of the first roller part 182*a* is the same as that of the second roller part 182*b*, but the inside diameter of the first roller part 182*a* is larger than that of the second roller part 182*b*. Therefore, the electric resistance of the first roller part 182*a* is lower than that of the second roller part 182*b*.

Figure 18:
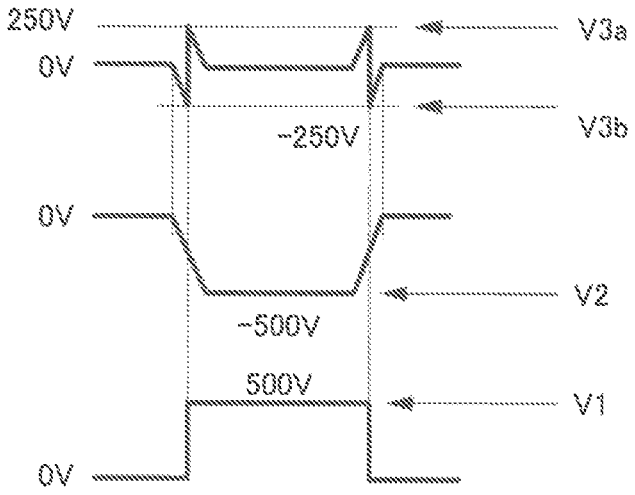
FIG. 18 is a diagram for explaining a distribution profile of voltages for charge elimination.

By constructing the charge elimination roller 18*a* as described above, in the case of turning on the switch 36 illustrated in FIG. 2 and applying the voltage V2 for charge elimination to the pair of charge elimination rollers 18*a* and 18*b*, the distribution profile of the voltage V2 for charge elimination in the direction perpendicular to the sheet carriage direction becomes a valley shape as illustrated in FIG. 18. Concretely, as an example, in the case of setting the voltage V1 for resistance measurement to 500V and setting the voltage V2 for charge elimination to −500V in accordance with the volume resistivity of the first roller part 182*a*, the distribution profile of the voltage V2 for charge elimination becomes a shape in which the level of −500V is the bottom part and both ends of the bottom part obliquely rise toward the level of 0V. In the specification, the voltage distribution profile is defined by a profile of the case in which, using the case where the voltage is 0V as a reference, positive voltage is on the upper side and negative voltage is on the lower side.

In the case where the distribution profile of the voltage V2 for charge elimination has a valley shape as described above, as compared with the case where the voltage distribution profile has a concave shape (refer to FIGS. 9 and 11), the absolute value of charges remaining in the sheet after charge elimination is smaller. Concretely, as illustrated in FIG. 16, the surface potentials V3*a* and V3*b* of the sheet after charge elimination can be set to a level smaller than the above-described threshold voltage Vsh, that is, ±250V. Therefore, the charges remaining in the sheet after charge elimination can be suppressed to a level that transfer in the transfer unit 27 is not influenced.

In the roller structure illustrated in FIG. 16, the roller nip part 182 is divided into the first roller part 182*a* and the second roller part 182*b*, and the mixing ratio of the conductive filler in the first roller part 182*a* is set higher than that of the conductive filler in the second roller part 182*b*. However, the present invention is not limited to the roller structure. For example, although not illustrated, a roller structure in which the mixing ratio of the conductive filler in the roller nip part 182 is reduced step by step or continuously from the center part in the roller center-axis direction toward the roller end may be employed.

Operation of Image Forming Device

Subsequently, the operation of the image forming device 1 according to the embodiment of the present invention will be described.

As an example of the operation of the image forming device 1, the operation (control method) of the image forming device 1 when the sheet 20 supplied from the sheet supply unit 23 passes through the resist unit 14, the resistance measuring unit 16, and the transfer unit 27 in order will be described.

Figure 19:
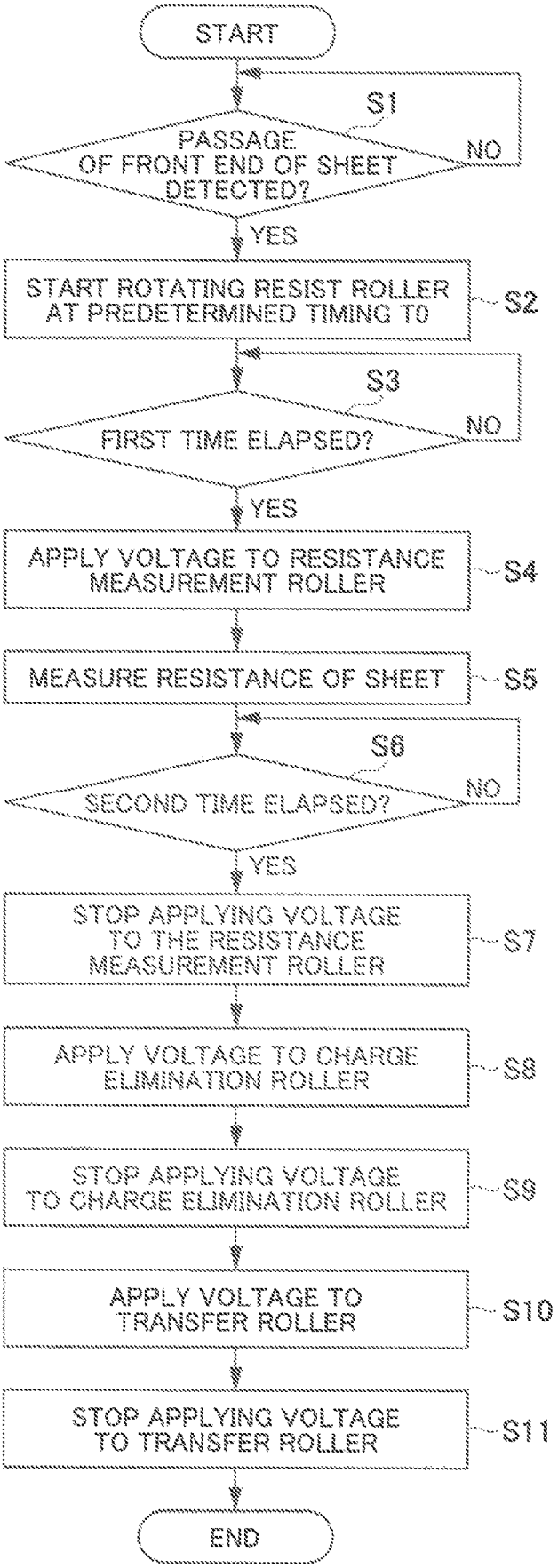
FIG. 19 is a flowchart illustrating the operation procedure of the image forming device according to the embodiment of the present invention.

FIG. 19 is a flowchart illustrating the operation procedure of the image forming device 1 according to the embodiment of the present invention.

First, the control unit 50 repeatedly checks whether the sheet detecting unit 30 detects passage of the front end of the sheet 20 fed from the sheet supply unit 23 to the sheet carriage path 10 (step S1). When the control unit 50 determines that the sheet detecting unit 30 detects passage of the front end of the sheet 20, rotation of a pair of resist rollers is started at a predetermined timing T0 (step S2). The predetermined timing T0 is set on the basis of time necessary for the front end of the sheet 20 to collide with the nip part of the pair of resist rollers and for the sheet 20 to form a predetermined loop, time necessary to feed the sheet 20 in the loop shape to the transfer unit 27, and time necessary for a toner image on the intermediate transfer belt 25 to reach the transfer unit 27. The pair of resistance measurement rollers 16*a* and 16*b* and the pair of charge elimination rollers 18*a* and 18*b* start rotating at the same time as, for example, a pair of resist rollers so as to carry the sheet 20 at the same sheet carriage speed as that of the pair of resist rollers.

Next, the control unit 50 determines whether first time elapsed since the above-described predetermined timing T0 (step S3). When time required since the pair of resist rollers starts rotating at the predetermining T0 until the front end of the sheet 20 reaches the nip parts of the pair of charge elimination rollers 18*a* and 18*b* in the sheet carriage path 10 is defined as "T1 (second)", the first time is time which is set under the condition of T1 or longer.

Figure 20A:
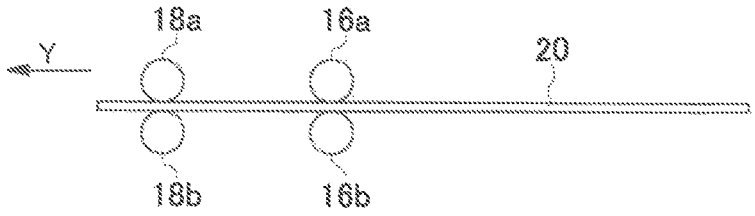
FIGS. 20A to 20G are schematic side views each illustrating a state where a sheet is carried by the resistance measurement rollers and the charge elimination rollers.

The control unit 50 turns on the switch 32 (refer to FIG. 2) of the resistance measurement circuit, thereby applying voltage for resistance measurement to the pair of resistance measurement rollers 16*a* and 16*b* (step S4). Consequently, as illustrated in FIG. 20A, when the same sheet 20 is sandwiched by the pair of resistance measurement rollers 16*a* and 16*b* and the pair of charge elimination rollers 18*a* and 18*b*, the voltage for resistance measurement is applied to the pair of resistance measurement rollers 16*a* and 16*b*.

When the voltage for resistance measurement is applied to the pair of resistance measurement rollers 16*a* and 16*b*, the voltage making the upper-side resistance measurement roller 16*a* as the positive electrode and the lower-side resistance measurement roller 16*b* as the negative electrode is applied to the sheet 20 which is in contact with each of the roller nip parts 162. Consequently, charges are given to the sheet 20 by the pair of resistance measurement rollers 16*a* and 16*b*. The charges are accumulated on the surface of the sheet 20 and the inside of the sheet 20 by the capacitance components of the sheet 20. In the specification, a region in which charges are accumulated in the sheet 20 by applying the voltage for resistance measurement to the pair of resistance measurement rollers 16*a* and 16*b* is defined as a "charged region". When the voltage V1 for resistance measurement is applied to the pair of resistance measurement rollers 16*a* and 16*b*, current according to the resistance of the sheet 20 itself flows in the sheet 20 sandwiched between the pair of resistance measurement rollers 16*a* and 16*b*. The value of the current flowing in the sheet 20 is notified from the ammeter 33 to the control unit 50. On the basis of the value of the current notified from the ammeter 33, the control unit 50 measures the resistance of the sheet 20 (step S5). The way of obtaining the resistance of the sheet 20 is as described above.

The control unit 50 determines whether second time has elapsed since the above-described predetermining timing T0 (step S6). The second time is time longer than the first time. When time required since application of the voltage for resistance measurement to the pair of resistance measurement rollers 16*a* and 16*b* is started until the front end of the charged region in the sheet 20 reaches the nip parts of the pair of charge elimination rollers 18*a* and 18*b* in the sheet carriage path 10 is defined as "T2 (second)", the second time is time which is set under the condition of less than T2.

Figure 20B:
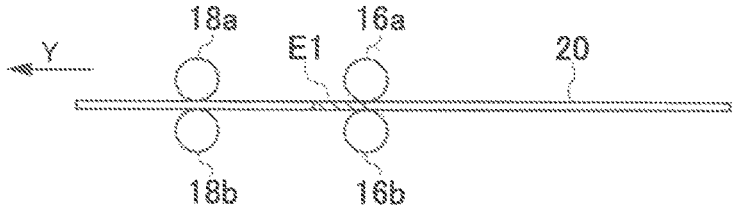
Figure 20C:
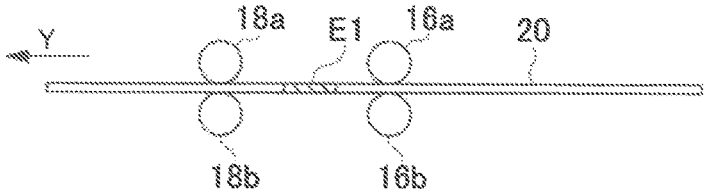
Figure 21A:
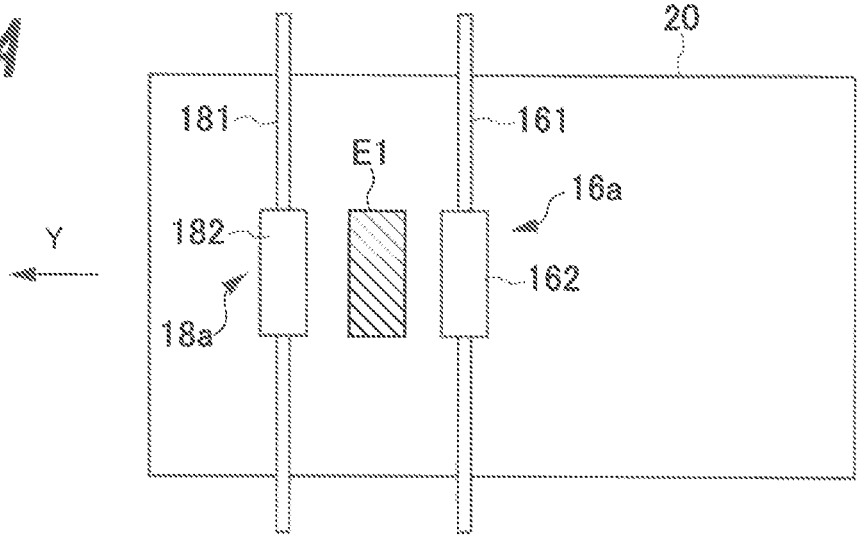
FIGS. 21A and 21B are schematic plan views each illustrating a state where a sheet is carried by the resistance measurement roller and the charge elimination roller.

The control unit 50 turns off the switch 32 of the resistance measurement circuit, thereby stopping application of the voltage to the pair of resistance measurement rollers 16*a* and 16*b* (step S7). By the operation, as illustrated in FIG. 20B, a charged region E1 having a predetermined size is formed in the sheet 20. The size of the charged region E1 is determined by the sheet carriage distance since the switch 32 is turned on until the switch is turned off and the roller width W1 (refer to FIG. 3) of the resistance measurement rollers 16*a* and 16*b*. After turning of the switch 32, as the sheet 20 is carried with the rotation of the pair of resistance measurement rollers 16*a* and 16*b* and the pair of charge elimination rollers 18*a* and 18*b* and, as illustrated in FIGS. 20C and 21A, the position of the charged region E1 approaches the charge elimination rollers 18*a* and 18*b*. When the period of applying the voltage for resistance measurement is defined as "first voltage application period Tv1", the first voltage application period Tv1 can be expressed as FIG. 22.

Figure 20D:
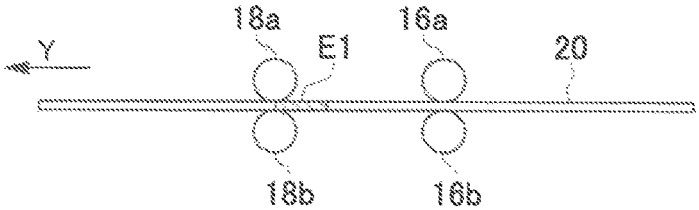
Figure 20E:
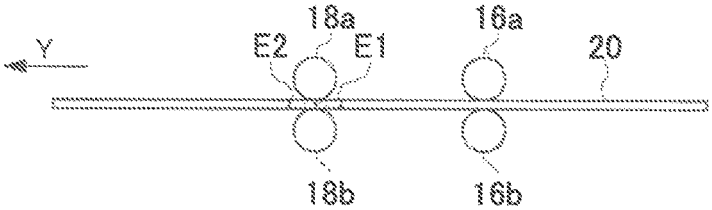

By turning on the switch 36 of the charge eliminating circuit (refer to FIG. 2), the control unit 50 applies the voltage for charge elimination to the pair of charge elimination rollers 18*a* and 18*b* (step S8). Consequently, when the pair of resistance measurement rollers 16*a* and 16*b* and the pair of charge elimination rollers 18*a* and 18*b* sandwich the same sheet 20, the voltage for charge elimination is applied to the pair of charge elimination rollers 18*a* and 18*b*. The timing of applying the voltage for charge elimination is set in accordance with the timing that the front end of the charged region E1 reaches the nip parts of the pair of charge elimination rollers 18*a* and 18*b* as illustrated in FIG. 20D. In other words, the control unit 50 turns on the switch 36 at the same time when the front end of the charged region E1 reaches the nip parts of the pair of charge elimination rollers 18*a* and 18*b*. By the operation, as illustrated in FIG. 20E, a part of the charged region E1 passed through the pair of charge elimination rollers 18*a* and 18*b* changes to a charge elimination region E2. The charge elimination region E2 is a region from which charges are eliminated by applying the voltage for charge elimination to the pair of charge elimination rollers 18*a* and 18*b*. The front end of the charged region E1 is the end of the charged region E1 positioned on the downstream side in the sheet carriage direction Y.

The control unit 50 determines the timing of applying the voltage for charge elimination by the second voltage applying unit (the power supply 35 for charge elimination and the switch 36) on the basis of the timing of applying the voltage for resistance measurement by the first voltage applying unit (the power supply 31 for resistance measurement and the switch 32) and the sheet carriage speed. Concretely, the control unit 50 determines the timing of applying the voltage for charge elimination as follows.

Figure 23:
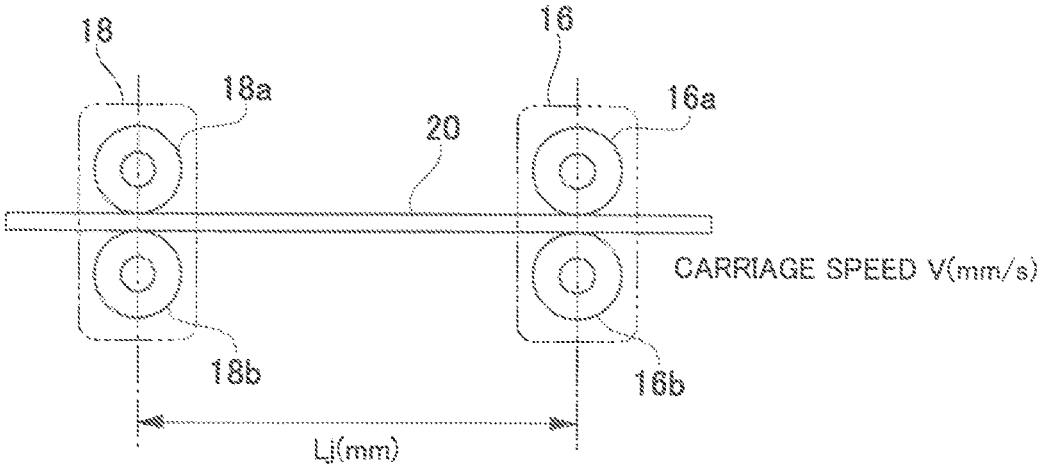
FIG. 23 is a diagram for explaining a method of determining a voltage application timing by the control unit.

First, the timing of starting application of the voltage for resistance measurement to the pair of resistance measurement rollers 16*a* and 16*b* is set as T11, the timing of starting application of the voltage for charge elimination to the pair of charge elimination rollers 18*a* and 18*b* is set as T12, and the time difference between the timings T12 and T11 is set as ΔT (second). As illustrated in FIG. 23, the roller-axis distance between the resistance measurement rollers 16*a* and 16*b* and the charge elimination rollers 18*a* and 18*b* in the sheet carriage direction Y is set as Lj (mm), and the carriage speed of the sheet 20 is set as Vs (mm/second). In this case, the control unit 50 computes ΔT by the following formula (1).

$$\Delta T = Li/Vs \quad (1)$$

The control unit 50 controls the turn-on/off timings of the switch 32 of the resistance measurement circuit and the turn-on/off timings of the switch 36 of the charge elimination circuit so that the application of the voltage V2 for charge elimination to the pair of charge elimination rollers 18*a* and 18*b* is started at the timing when time of ΔT elapsed since the timing T11 when application of the voltage for resistance measurement started to the pair of resistance measurement rollers 16*a* and 16*b*. By the control, charge elimination by the pair of charge elimination rollers 18*a* and 18*b* can be started at the same time that the front end of the charged region E1 reaches the nip parts of the pair of charge elimination rollers 18*a* and 18*b*. Consequently, the charges in the sheet 20 can be eliminated without leaving the residual charges at the front end side of the charged region E1.

Figure 20F:
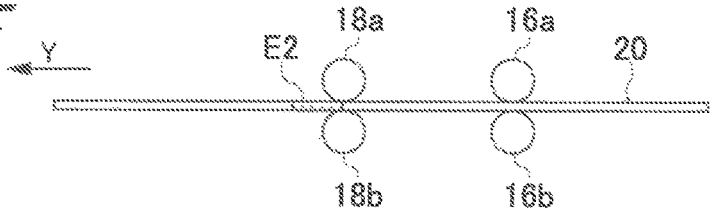
Figure 20G:
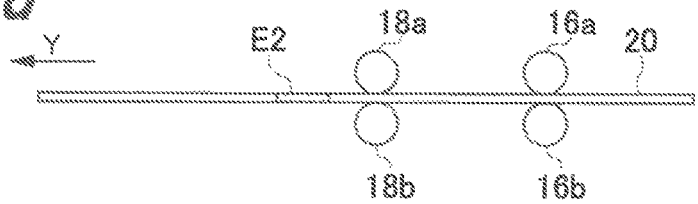
Figure 21B:
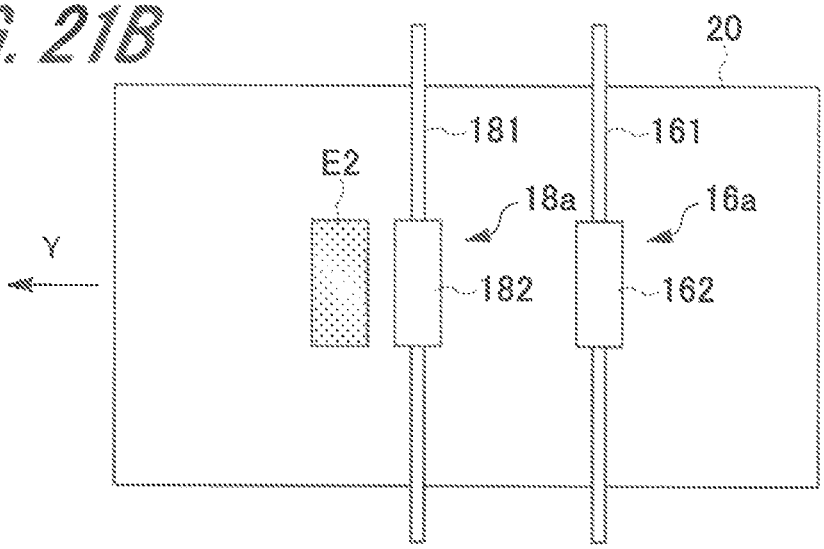
Figure 22:
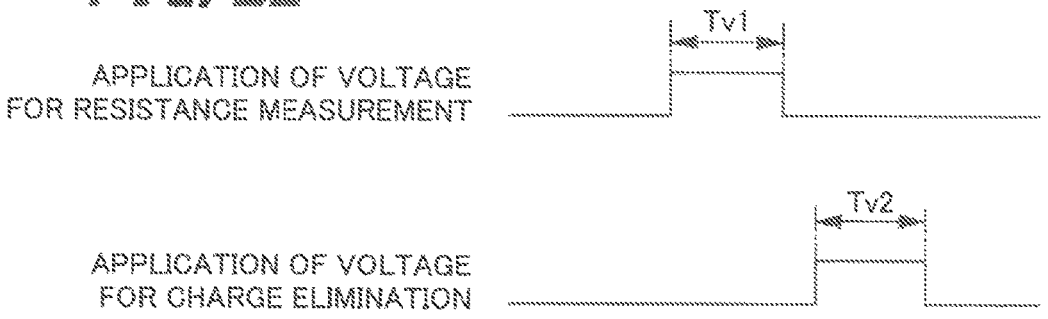
FIG. 22 is a timing chart illustrating a period of applying the voltage for resistance measurement and a period of applying the voltage for charge elimination in an embodiment of the present invention.

By turning off the switch 36 at the timing when predetermined time T4 elapsed since the switch 36 is turned on, the control unit 50 stops applying the voltage to the pair of charge elimination rollers 18*a* and 18*b* (step S9). The predetermined time T4 is set to the same time since the switch 32 is turned on until it is turned off. Therefore, when the period of applying the voltage for charge elimination is defined as "second voltage application period Tv2", the second voltage application period Tv2 can be expressed in FIG. 22. As illustrated in FIG. 22, the control unit 50 controls the turn-on/off timings of the switches 32 and 36 so that the first voltage application period Tv1 and the second voltage application period Tv2 have the same length. By the control, to the same region in the sheet 20 as a target, the voltage for resistance measurement and the voltage for charge elimination can be applied. The control unit 50 controls the turn-on/off timings of the switches 32 and 36 so that the application timing of the voltage for resistance measurement and the application timing of the voltage for charge elimination do not overlap. Consequently, occurrence of discharge between the resistance measurement rollers 16*a* and 16*b* and the charge elimination rollers 18*a* and 18*b* can be suppressed. Only in the period in which the charged region E1 of the sheet 20 is sandwiched by the pair of charge elimination rollers 18*a* and 18*b*, the voltage for charge elimination, that is, the voltage of the reverse bias of the voltage for resistance measurement is applied to the pair of charge elimination rollers 18*a* and 18*b*. Consequently, without accumulating charges in the sheet 20 by application of the voltage for charge elimination, the charges accumulated in the sheet 20 by the pair of resistance measurement rollers 16*a* and 16*b* can be eliminated by the pair of charge elimination rollers 18*a* and 18*b*. Therefore, at the stage when the rear end of the charged region E1 reaches the nip parts of the pair of charge elimination rollers 18*a* and 18*b*, as illustrated in FIG. 20F, all of the charged region E1 of the sheet 20 is converted to the charge elimination region E2. After turning off the switch 36, as the sheet 20 is carried with the rotation of the pair of resistance measurement rollers 16*a* and 16*b* and the pair of charge elimination rollers 18*a* and 18*b* and, as illustrated in FIGS. 20G and 21B, the position of the charge elimination region E2 moves apart from the charge elimination rollers 18*a* and 18*b*. The rear end of the charged region E1 is the end of the charge region E1 positioned on the upstream side of the sheet carriage direction Y.

Conventionally, a charge eliminating method of eliminating charges of the sheet 20 by making a discharge brush connected to the ground come into contact with the surface of the sheet 20 is known. In the charge eliminating method, charges existing on the surface of the sheet 20 can be eliminated to some extent. However, charges existing in the sheet 20 cannot be eliminated. That is, in the conventional charge eliminating method, charges accumulated in the sheet 20 cannot be eliminated by application of voltage to the pair of resistance measurement rollers 16*a* and 16*b*. On the other hand, in the embodiment, since the voltage of the reverse bias of the voltage for resistance measurement is applied to the pair of charge elimination rollers 18*a* and 18*b*, not only the charges existing on the surface of the sheet 20 but also the charges existing in the sheet 20 can be eliminated.

By turning on the switch 38 of the transfer circuit (refer to FIG. 2), the control unit 50 applies the voltage for transfer to the pair of transfer rollers 27*a* and 27*b* (step S10). By the application, when the sheet 20 passes through the pair of transfer rollers 27*a* and 27*b*, a toner image on the intermediate transfer belt 25 is transferred from the intermediate transfer belt 25 to the sheet 20.

After that, by turning off the switch 38 at the timing when predetermined time T5 elapsed since the switch 38 is turned on, the control unit 50 stops the application of the voltage to the pair of transfer rollers 27*a* and 27*b* (step S11). The predetermined time T5 may be set so that the switch 38 is turned off after the rear end of the sheet 20 passes through the pair of transfer rollers 27*a* and 27*b*.

Effect of the Embodiment

As described above, in the image forming device 1 of the embodiment, the charge eliminating unit 18 is disposed between the transfer unit 27 and the resistance measuring unit 16. Consequently, by sandwiching the sheet 20 between the pair of charge elimination rollers 18*a* and 18*b* and, in such a state, applying the voltage for charge elimination to the pair of charge elimination rollers 18*a* and 18*b* by the power supply 35 for charge elimination, the charges accumulated in the sheet 20 can be eliminated. Therefore, occurrence of a trouble can be suppressed in the transfer unit 27 accompanying measurement of the resistance of the sheet 20.

In the image forming device 1 of the embodiment, the configuration is employed that the width (W2) of the charge elimination region E2 by the pair of charge elimination rollers 18*a* and 18*b* is wider than the width (W1) of the charged region E1 by the pair of resistance measurement rollers 16*a* and 16*b* and the absolute value of the voltage V2 for charge elimination is smaller than that of the voltage V1 for resistance measurement. Consequently, even when there is an error in process dimensions and attachment dimensions of the rollers 16*a*, 16*b*, 18*a*, and 18*b*, residual charges of the sheet 20 after the charge elimination can be reduced and occurrence of poor transfer by the residual charges can be suppressed.

Modifications and the Like

The present invention is not limited to the above-described embodiment but includes various modifications. For example, in the foregoing embodiment, the present invention has been described specifically so as to be easily understood. However, the present invention is not always limited to the device having all of the configurations described in the foregoing embodiment. A part of the configuration of an embodiment can be replaced with the configuration of another embodiment. The configuration of another embodiment can be added to that of an embodiment. It is possible to eliminate a part of the configuration of each embodiment or add another configuration or replace it with another configuration.

Although the resistance measuring unit 16 and the charge eliminating unit 18 are disposed on the downstream side in the sheet carriage direction of the resist unit 14 in the foregoing embodiment, the present invention is not limited to the disposition. For example, the resistance measuring unit 16 and the charge eliminating unit 18 can be disposed on the upstream side in the sheet carriage direction Y of the resist unit 14. In the sheet carriage direction Y, the resistance measuring unit 16 may be disposed on the upper stream side of the resist unit 14, and the charge eliminating unit 18 may be disposed on the downstream side of the resist unit 14.

Figure 24:
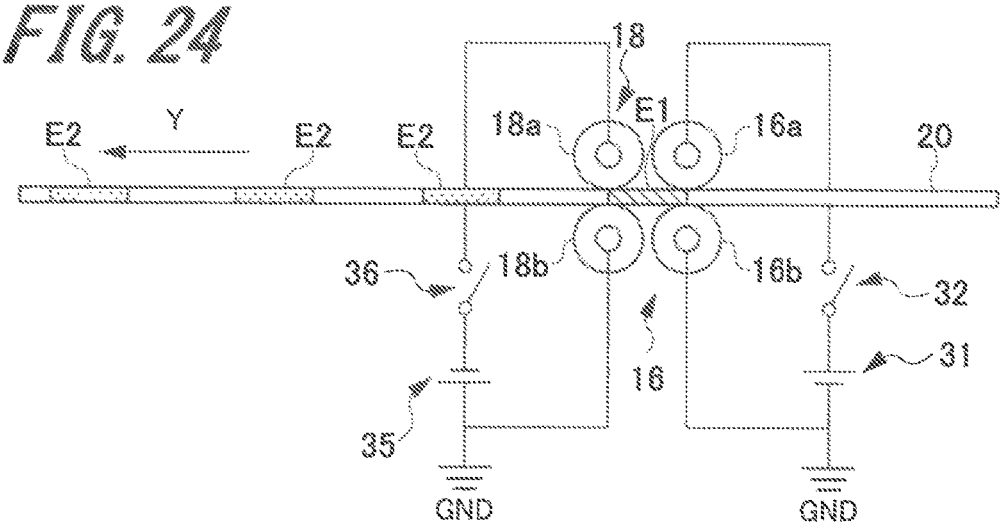
FIG. 24 is a schematic diagram illustrating the case of performing resistance measurement a plurality of times per sheet.

Although the case of performing measurement of the resistance of the sheet 20 only once per sheet 20 has been described in the foregoing embodiment, the present invention is not limited to the case. A configuration that, the control unit 50 controls the turn on/off timings of the switches 32 and 26 so as to perform measurement of the resistance of per sheet 20 a plurality of times as illustrated in FIG. 24 may be employed. When measurement of the resistance of the sheet 20 is performed a plurality of times per sheet 20, the resistance measurement can be performed in a wider range for one sheet 20. Therefore, the resistance distribution of the sheet 20 in the sheet carriage direction Y can be grasped. Preferably, the resistance measurement of each time is performed when the same sheet 20 is sandwiched by the pair of resistance measurement rollers 16*a* and 16*b* and the pair of charge elimination rollers 18*a* and 18*b*. By applying the voltage alternately to the pair of resistance measurement rollers 16*a* and 16*b* and the pair of charge elimination rollers 18*a* and 18*b* when the same sheet 20 is sandwiched by the pair of resistance measurement rollers 16*a* and 16*b* and the pair of charge elimination rollers 18*a* and 18*b*, without considering disturbance of the surface resistance, resistance measurement and charge elimination can be performed.

Although the example of connecting the positive electrode of the power supply 31 for resistance measurement to the resistance measurement roller 16*a* on the upper side and connecting the negative electrode of the power supply 35 for charge elimination to the charge elimination roller 18*a* on the upper side has been described in the foregoing embodiment, the present invention is not limited to the example. Hereinafter, other connection examples in the resistance measurement circuit and the charge elimination circuit will be described with reference to FIGS. 25A to 25G.

Figure 25A:
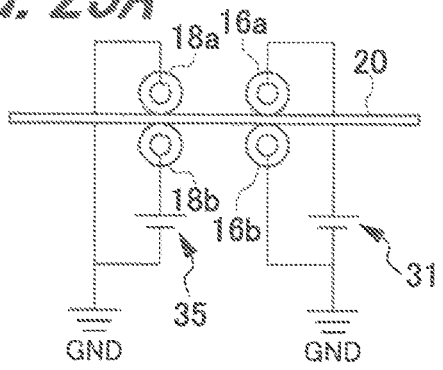
FIGS. 25A to 25G are schematic diagrams illustrating examples of electric connection to set the voltage for resistance measurement and the voltage for charge elimination as voltages of reverse biases.

FIG. 25A illustrates a connection example of connecting the positive electrode of the power supply 31 for resistance measurement to the resistance measurement roller 16*a* on the upper side and connecting the positive electrode of the power supply 35 for charge elimination to the charge elimination roller 18*b* on the lower side.

Figure 25B:
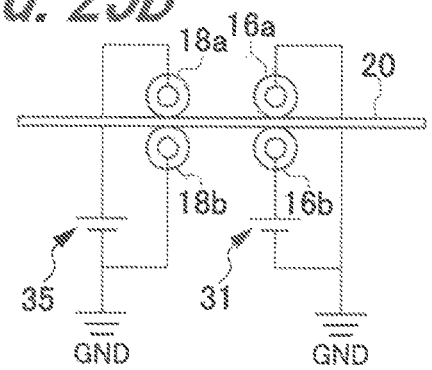

FIG. 25B illustrates a connection example of connecting the positive electrode of the power supply 31 for resistance measurement to the resistance measurement roller 16*b* on the lower side and connecting the positive electrode of the power supply 35 for charge elimination to the charge elimination roller 18*a* on the lower side.

Figure 25C:
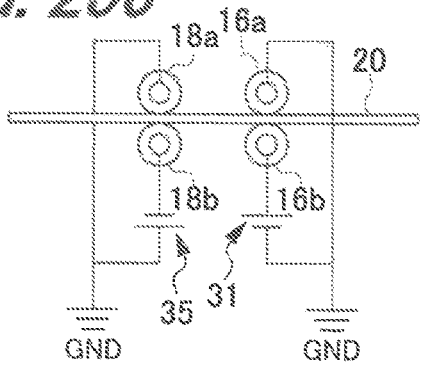

FIG. 25C illustrates a connection example of connecting the positive electrode of the power supply 31 for resistance measurement to the resistance measurement roller 16*b* on the lower side and connecting the negative electrode of the power supply 35 for charge elimination to the charge elimination roller 18*b* on the lower side.

Figure 25D:
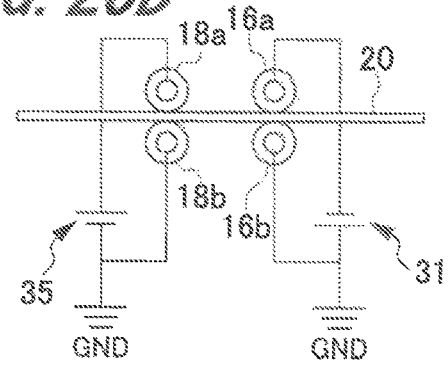

FIG. 25D illustrates a connection example of connecting the negative electrode of the power supply 31 for resistance measurement to the resistance measurement roller 16*a* on the upper side and connecting the positive electrode of the power supply 35 for charge elimination to the charge elimination roller 18*a* on the upper side.

Figure 25E:
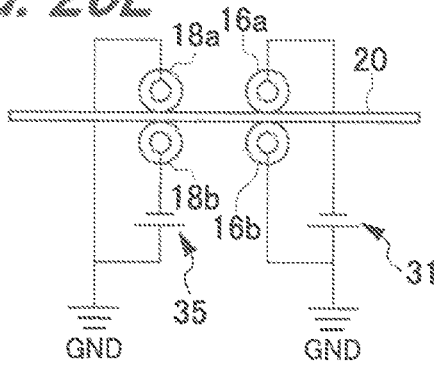

FIG. 25E illustrates a connection example of connecting the negative electrode of the power supply 31 for resistance measurement to the resistance measurement roller 16*a* on the upper side and connecting the negative electrode of the power supply 35 for charge elimination to the charge elimination roller 18*b* on the lower side.

Figure 25F:
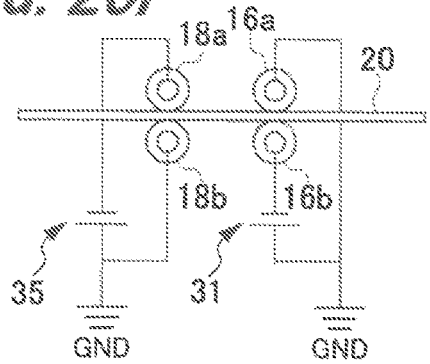

FIG. 25F illustrates a connection example of connecting the negative electrode of the power supply 31 for resistance measurement to the resistance measurement roller 16*b* on the lower side and connecting the negative electrode of the power supply 35 for charge elimination to the charge elimination roller 18*a* on the upper side.

Figure 25G:
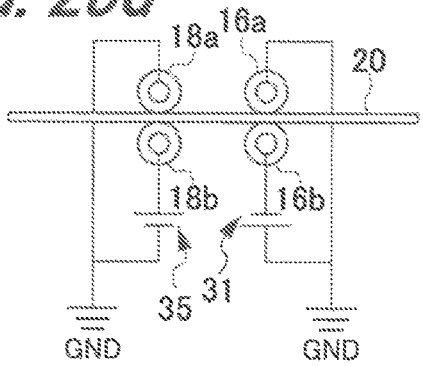

FIG. 25G illustrates a connection example of connecting the negative electrode of the power supply 31 for resistance measurement to the resistance measurement roller 16*b* on the lower side and connecting the positive electrode of the power supply 35 for charge elimination to the charge elimination roller 18*b* on the lower side.

Also in the case of employing such a connection example, the voltage for resistance measurement and the voltage for charge elimination can be made voltages of biases reverse to each other.

Although the embodiments of the present invention have been described and illustrated above, the disclosed embodiments are made for purposes of illustration and example only and not limitation. The scope of the present invention should be interpreted by the terms of the appended claims.

DESCRIPTION OF REFERENCE NUMERALS

1 . . . image forming device
16*a*, 16*b* . . . resistance measurement rollers (resistance measurement members)
18*a*, 18*b* . . . charge elimination rollers (charge elimination members)
20 . . . sheet
27 . . . transfer unit
31 . . . power supply for resistance measurement (first voltage applying unit)
32 . . . switch (first voltage applying unit)
35 . . . power supply for charge elimination (second voltage applying unit)
36 . . . switch (second voltage applying unit)
50 . . . control unit (voltage control unit)
E1 . . . charged region
E2 . . . charge elimination region
Y . . . sheet carriage direction
V1 . . . voltage for resistance measurement
V2 . . . voltage for charge elimination
W1 . . . roller width (nip width)
W2 . . . roller width (nip width)

What is claimed is:

1. An image forming device comprising:

a transfer unit transferring a toner image to a sheet;

a resistance measurement member disposed on an upstream side in a sheet carriage direction of the transfer unit and for measuring resistance of the sheet;

a charge elimination unit disposed between the transfer unit and the resistance measurement member in the sheet carriage direction;

a first voltage applying unit applying voltage for resistance measurement to the resistance measurement member; and a second voltage applying unit applying voltage for charge elimination as a voltage which is reverse bias of the voltage for resistance measurement to the charge elimination unit, wherein the width of a charge elimination region by the charge elimination member is wider than that of a charged region by the resistance measurement member in a direction perpendicular to the sheet carriage direction, and the absolute value of the voltage for charge elimination is smaller than that of the voltage for resistance measurement.

2. The image forming device according to claim 1, wherein the resistance measurement member is made by a pair of resistance measurement rollers which sandwich the sheet, the charge elimination member is made by a pair of charge elimination rollers which sandwich the sheet, and a nip width of the sheet by the pair of charge elimination rollers is wider than that of the sheet by the pair of resistance measurement rollers in a direction perpendicular to the sheet carriage direction.

3. The image forming device according to claim 2, wherein the charge elimination roller has a roller axis part and a roller nip part, the roller nip part has a first roller part having first electric resistance and a second roller part having second electric resistance which is higher than the first electric resistance, and the second roller part is disposed on a roller end side more than the first roller part in the center axis direction of the roller axis part.

4. The image forming device according to claim 3, wherein the resistance measurement roller has a roller axis part and a roller nip part, and both end positions of the roller nip part of the resistance measurement roller are disposed within a region of the second roller part in the charge elimination roller in a direction perpendicular to the sheet carriage direction.

5. The image forming device according to claim 4, wherein both end positions of the roller nip part of the resistance measurement roller are disposed in the center position of the second roller part in the charge elimination roller.

6. The image forming device according to claim 1, wherein the absolute value of the voltage for charge elimination is the half of the absolute value of the voltage for resistance measurement.

7. The image forming device according to claim 1, wherein a threshold voltage at which poor transfer occurs in the transfer unit is larger than the difference between the absolute value of the voltage for resistance measurement and the voltage for charge elimination.

8. The image forming device according to claim 1, further comprising a voltage control unit controlling the first and second voltage applying units, wherein the voltage control unit determines a timing of applying the voltage for charge elimination by the second voltage applying unit on the basis of a timing of applying the voltage for resistance measurement by the first voltage applying unit and carriage speed of the sheet.

9. The image forming device according to claim 1, wherein a distribution profile of the voltage for charge elimination in a direction perpendicular to the sheet carriage direction has a valley shape.

* * * * *